US011703223B2

(12) United States Patent
Huelson et al.

(10) Patent No.: US 11,703,223 B2
(45) Date of Patent: Jul. 18, 2023

(54) MULTI-FUNCTION SIGHT PORT AND METHOD OF INSTALLING A MULTI-FUNCTION SIGHT PORT

(71) Applicant: ONPOINT TECHNOLOGIES, LLC, Wichita, KS (US)

(72) Inventors: Eric Christopher Huelson, Golden, CO (US); Eric Francis Gebhard, Tulsa, OK (US); Michael Jozef Barjaktarevic, Broomfield, CO (US)

(73) Assignee: ONPOINT TECHNOLOGIES, LLC, Wichita, KS (US)

( * ) Notice: Subject to any disclaimer, the term of this patent is extended or adjusted under 35 U.S.C. 154(b) by 217 days.

(21) Appl. No.: 17/005,341

(22) Filed: Aug. 28, 2020

(65) Prior Publication Data

US 2021/0080105 A1 Mar. 18, 2021

Related U.S. Application Data

(60) Provisional application No. 62/900,364, filed on Sep. 13, 2019.

(51) Int. Cl.
*F23M 11/04* (2006.01)
*F23N 5/08* (2006.01)
*F23N 5/20* (2006.01)

(52) U.S. Cl.
CPC ..... *F23M 11/045* (2013.01); *F23N 5/082* (2013.01); *F23N 5/203* (2013.01)

(58) Field of Classification Search
CPC ..... F23M 7/00; F23M 11/04; F23M 11/042; F23M 11/045; F23M 2900/00; F23M 7/02; F23N 2900/05005; F23N 2229/20; F27D 21/00; F27D 21/0014; F27D 21/02
USPC ..... 432/237, 247, 250; 110/173 C; 122/498, 122/6.5
See application file for complete search history.

(56) References Cited

U.S. PATENT DOCUMENTS

| | | | |
|---|---|---|---|
| 1,717,636 | A | 6/1929 | Vastine |
| 1,887,654 | A | 11/1932 | Basil |
| 1,973,171 | A | 9/1934 | Jacobi |
| 2,125,021 | A | 7/1938 | Haynes |

(Continued)

FOREIGN PATENT DOCUMENTS

| | | | |
|---|---|---|---|
| CN | 102242938 | B | 12/2012 |
| CN | 205279146 | U | 6/2016 |
| CN | 107420940 | B | 7/2019 |

OTHER PUBLICATIONS

International Search Report and Written Opinion received for PCT Application No. PCT/IB2020/058462, dated Nov. 27, 2020, 9 pages.

*Primary Examiner* — Avinash A Savani

(57) ABSTRACT

A multi-function sight port door includes a sensor mount attached at an aperture within the sight port door. A sensor is mounted to the sensor mount and configured to monitor the interior of a heater that the multi-function sight port door is mounted to. The multi-function sight port door is also configured to open to allow visual inspection of the interior of the heater while the sensor is mounted thereto. The multi-function sight port may be configured to allow for one or more of X-axis, Y-axis, Z-axis, tilt, roll, and yaw positioning of the sensor as mounted to the sight port door. The sensor may be a temperature sensor, pressure sensor, flame scanner, gas analyzer, optical-based sensor, thermal imager, thermal camera, or laser-based analyzer.

32 Claims, 23 Drawing Sheets

(56) References Cited

U.S. PATENT DOCUMENTS 2,456,100 A * 12/1948 Wood ..... B25B 5/12 269/286
2,584,404 A * 2/1952 Webb ..... F23M 7/00 49/386
2,704,999 A 3/1955 Schoessow
2,758,554 A * 8/1956 Ohman ..... F23M 7/00 110/179
2,850,005 A 9/1958 Good et al.
2,926,658 A 3/1960 Cleon
3,085,464 A 4/1963 Robert
3,145,705 A 8/1964 Bruce et al.
3,276,442 A 10/1966 Svendsen
3,385,285 A 5/1968 King
4,016,820 A * 4/1977 Johnson ..... F23M 7/00 202/242
4,751,765 A * 6/1988 Wu ..... E05F 1/1215 16/256
4,796,543 A * 1/1989 Barkley ..... F23M 7/00 110/173 R
4,981,088 A 1/1991 Burris
5,139,412 A * 8/1992 Kychakoff ..... F23N 5/082 356/601
5,803,021 A * 9/1998 Rourke ..... F23M 7/00 122/498
5,830,407 A * 11/1998 Cates ..... C21C 5/4673 266/44
5,910,210 A * 6/1999 Violi ..... A47J 39/006 165/64
6,412,221 B1 * 7/2002 Emsbo ..... F23M 7/00 49/154
6,415,724 B1 * 7/2002 Albrecht ..... F23M 7/04 122/498
7,767,137 B2 * 8/2010 Wunsche ..... F27D 1/18 266/135
9,909,354 B1 * 3/2018 Kirkpatrick ..... E05D 15/48
10,443,893 B2 * 10/2019 Arnold ..... F24H 9/20
2005/0115167 A1 * 6/2005 Class ..... F23M 11/045 52/82
2009/0136640 A1 * 5/2009 Embury ..... A23L 5/13 426/510
2015/0104750 A1 * 4/2015 Masciarelli ..... G01N 21/72 431/13
2015/0168070 A1 * 6/2015 Trent, Jr. ..... F27D 19/00 432/250
2016/0003685 A1 * 1/2016 Walla ..... G01K 1/143 374/208
2016/0033202 A1 * 2/2016 Walla ..... F27D 21/02 110/173 C
2016/0178118 A1 * 6/2016 Arnold ..... F24H 9/20 248/27.1
2018/0031236 A1 * 2/2018 Gaudioso ..... F23N 5/20
2019/0250251 A1 * 8/2019 Gibson ..... G01S 17/10
2019/0331595 A1 * 10/2019 Matsuo ..... G01N 21/55

* cited by examiner

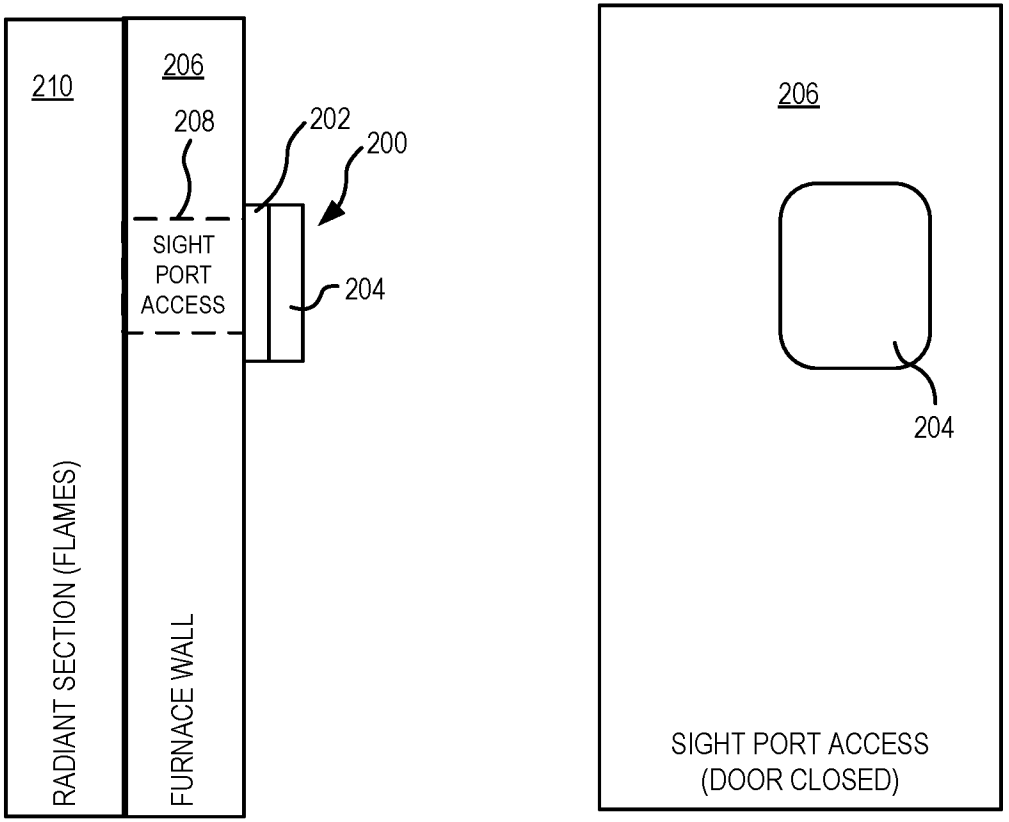
FIG. 2 (PRIOR ART)
FIG. 3 (PRIOR ART)
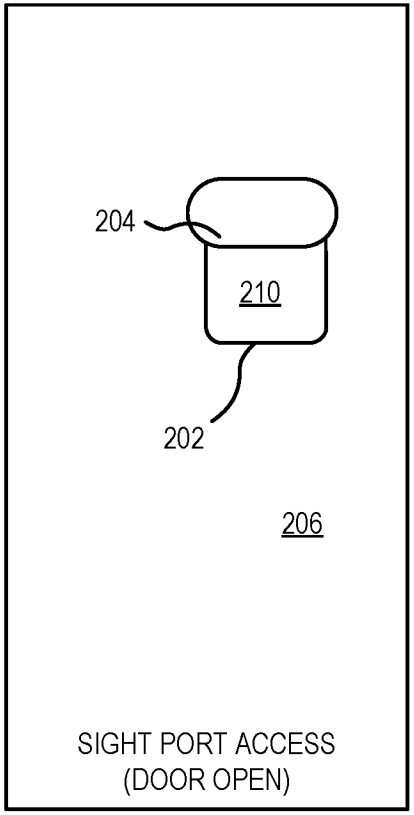
FIG. 4 (PRIOR ART)

MULTI-FUNCTION SIGHT PORT AND METHOD OF INSTALLING A MULTI-FUNCTION SIGHT PORT

CROSS-REFERENCE TO RELATED APPLICATIONS

The present application claims priority to U.S. Provisional Patent Application No. 62/900,364 filed Sep. 13, 2019. The entire contents of the aforementioned provisional patent application are incorporated herein by reference.

BACKGROUND

Combustion systems operate by converting a fuel source with air into thermal energy. The thermal energy is transferred to a material which undergoes a given process (e.g., material state change, chemical reaction, etc.). FIG. 1 shows a diagram of a combustion system 100, in an example. Air and fuel are input into a heater housing 102 via one or more burners 104. The air and fuel combusts to create a thermal energy 106 that is then transferred to process material located in one or more process tubes 108.

Optimal conversion of the fuel and air into the thermal energy 106, and transfer of the thermal energy 106 to the process material in the process tubes 108 is important. To monitor said conversion and transfer of the thermal energy 106, a plurality of sight ports 110 are located within the heater housing 102. FIG. 1 shows five sight ports 110, as an example, but any given heater may include any number of sight ports 110.

FIGS. 2-5 depict an example block diagram of a prior art sight port 200. As shown, the sight port 200 includes a sight port base 202 hingedly coupled to a port door 204. The base plate is mounted to the heater wall 206. A sight port access aperture 208 is within the heater wall 206 that allows the interior portion 210 of the furnace to be viewed when the hatch is open (FIG. 4).

FIG. 6 depicts an actual sight port including a sight port base plate 602, which is an example of sight port base 202, and port door 604, which is an example of port door 204, hingedly coupled thereto. The port door 604 is shown with insulating material 606 attached thereto to maintain heat within the heater when the port door 604 is closed. It should be appreciated that port door 204 may also include said insulating material.

As combustion system technology has developed, sensor-based monitor technology has also developed. For example, a variety of sensors have been developed to monitor the internal components of the combustion system 100. For example, internal components and conditions within the heater 102 are measured by one or more of temperature sensors, pressure sensors, flame scanners, thermal imagers, visible cameras, thermal cameras, gas analyzers (e.g., oxygen, combustibles, NOx, or other air composition sensors/analyzers), and laser-based analyzers (that detect air composition, temperature, and other measurements; such laser-based devices developed by ZOLO Technologies), as well as other devices known in the art.

Each of these devices and sensors requires access into the combustion system 100 via the heater housing 102. This access requires drilling or cutting into the heater housing 102, which occurs during shut-down periods of the combustion system 102. Furthermore, access points for these sensors provides susceptible areas for tramp-air (undesired ambient air that is pulled into the heater housing 102 via pressure differential between inside and outside of the heater housing 102) entrance into the heater housing 102.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure.

FIGS. 2-5 depict an example block diagram of a prior art sight port.

DETAILED DESCRIPTION OF THE EMBODIMENTS

Figure 1:
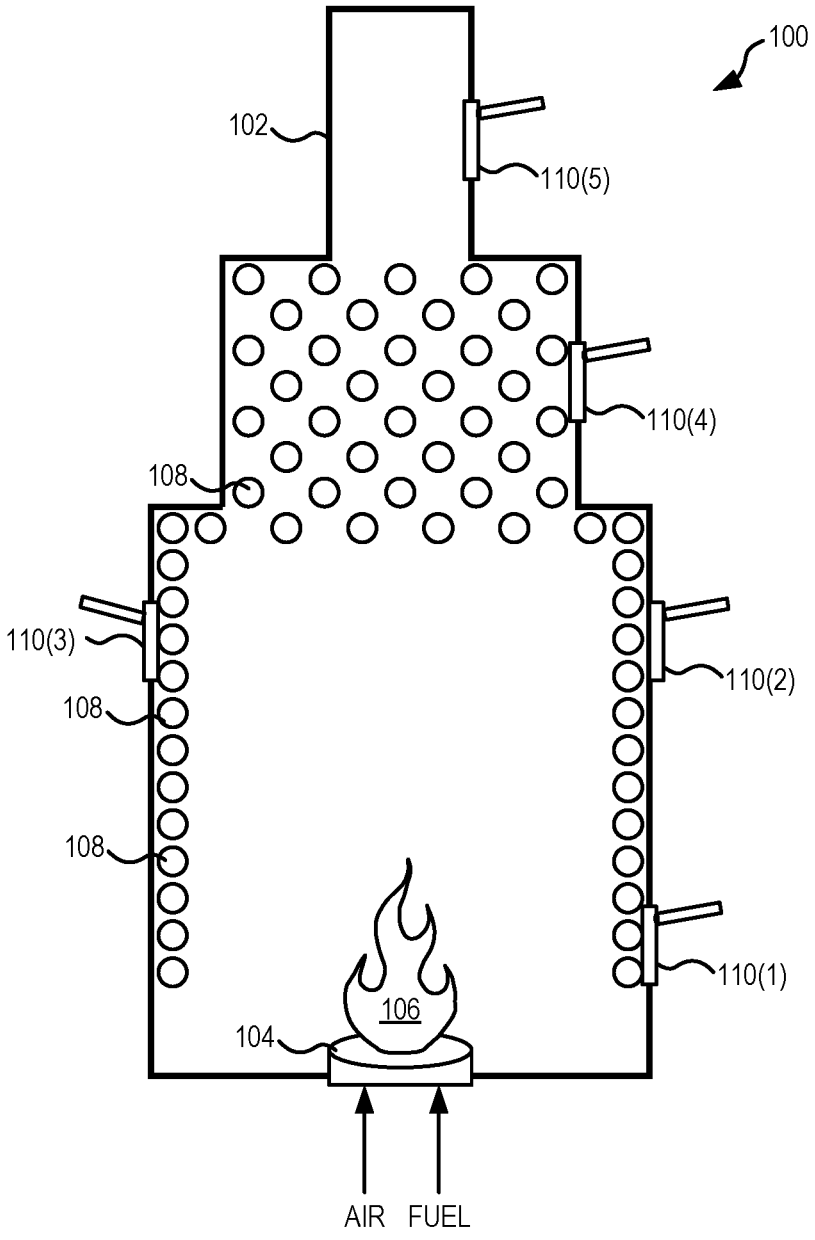
FIG. 1 (PRIOR ART)
FIG. 1 shows a diagram of a prior art combustion system, in an example.
Figure 5:
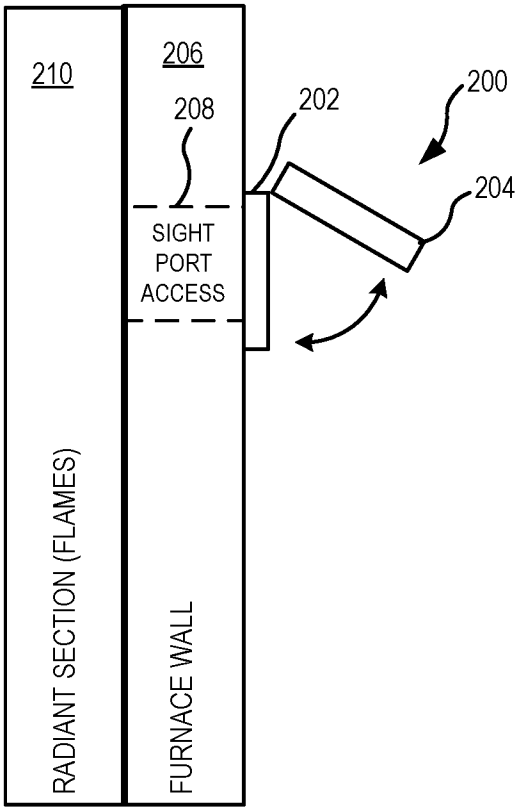
FIG. 5 (PRIOR ART)
Figure 6:
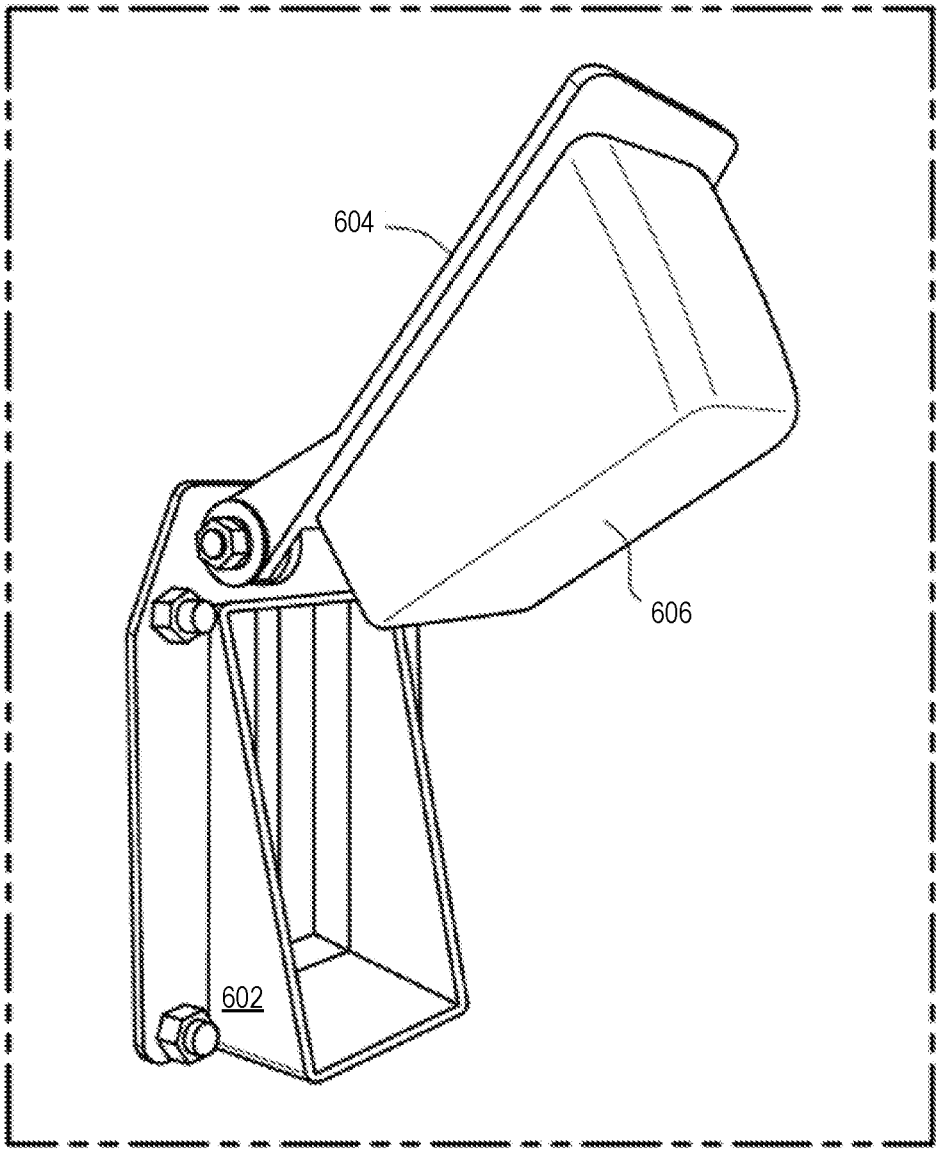
FIG. 6 (PRIOR ART)
FIG. 6 depicts an actual prior art sight port including a sight port base plate, which is an example of sight port base and port door of FIG. 2.
Figure 9:
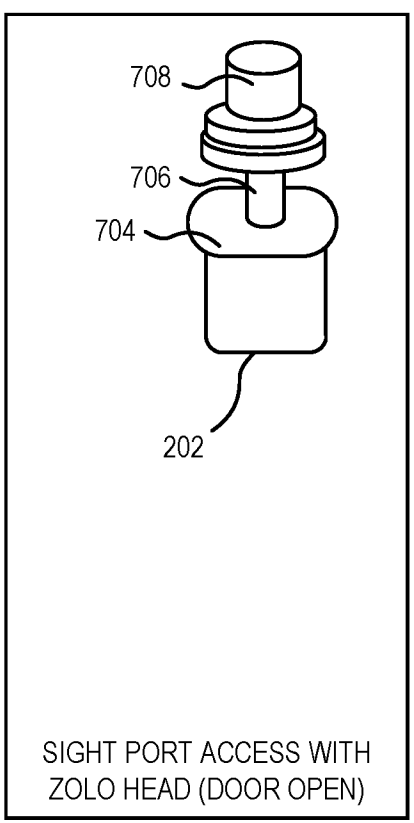
FIGS. 7-10 depict a block diagram of a multi-function sight port, in an embodiment.
Figure 8:
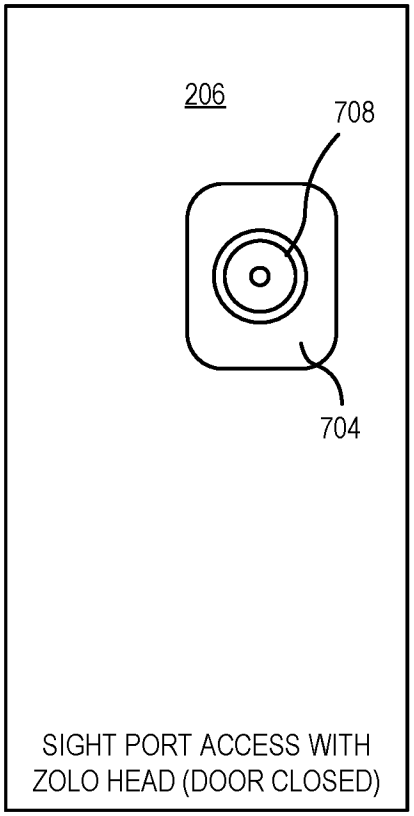
Figure 7:
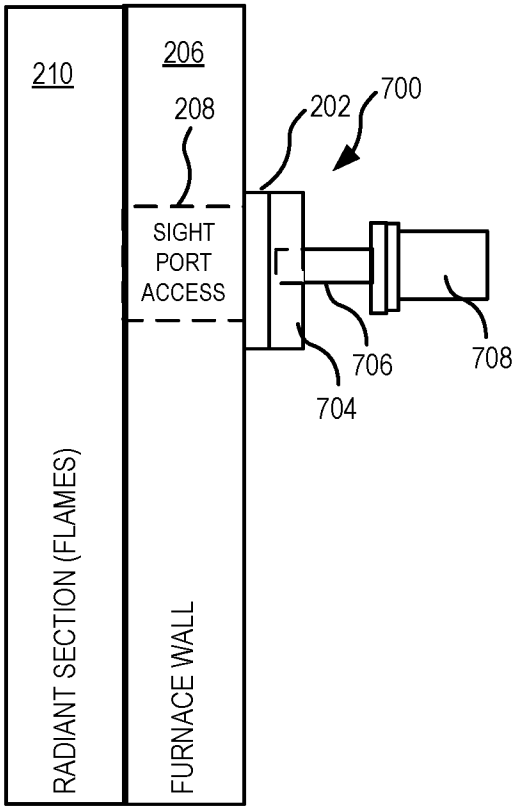
Figure 10:
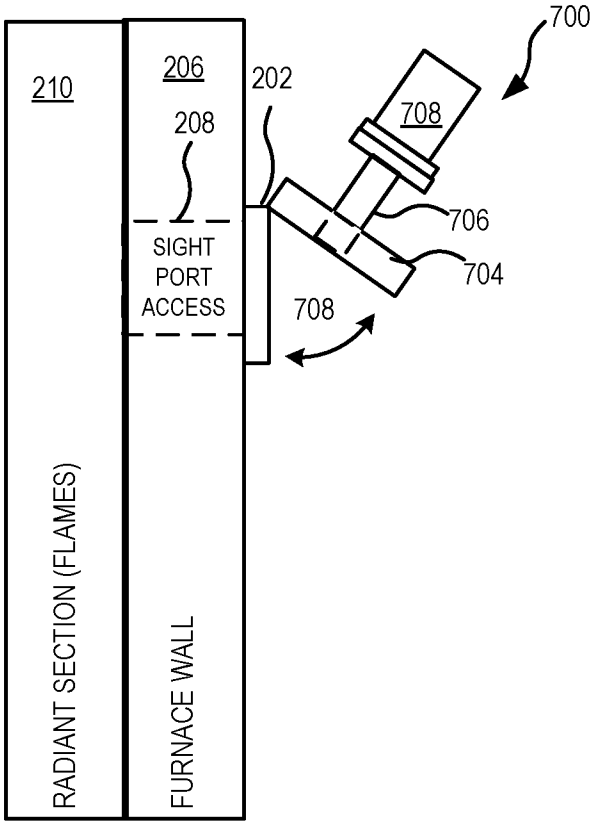

Embodiments herein acknowledge that, when retrofitting existing combustion systems with new devices, such retrofitting must occur during shut-down maintenance times resulting in loss of operating time of the combustion system. Certain embodiments herein address this problem by providing a sight port access hatch that can be retrofit onto existing sight ports thereby not requiring additional access points into the heater housing and allowing for installation of the new sensors without shut-down of the combustion system.

Embodiments disclosed herein acknowledge that, when adding additional sensors and monitor devices to a combustion system, a hole in the heater housing must be added resulting in potential tramp air access at the new hole. The embodiments disclosed herein address this problem by providing a multi-functional sight port hatch that is configured to utilize a single access point within the heater housing to provide multiple functions (e.g., visual, and device-based monitoring of the interior of the combustion heater).

The features of the embodiments discussed below are adaptable to sight ports of various sizes. Standard sight-ports are 11 inches by 14 inches, or 5 inches by 9 inches, but it should be appreciated that when "sight port" is referenced herein, it refers to a sight port of any size unless otherwise indicated.

FIGS. 7-10 depict a block diagram of a multi-function sight port 700, in an embodiment. Multi-function sight port 700 includes a port door 704 that couples to the existing sight port base 202 discussed above with respect to FIGS. 2-6. Port door 704 includes a sensor mount 706 coupled thereto. A sensor 708 is coupled to the sensor mount 706. The sensor mount 706 couples at a port-door aperture 710 within the port door 704 such that the sensor 708 is configured to sense information regarding the interior 210 of the heater through the aperture 208 within the heater wall 206, the port-door aperture 710, and an aperture in the sensor mount 706. It should be appreciated that the existing sight port base 202 may not be existing in all embodiments, for example where the multi-function sight port 700 is not a retrofit to an existing sight port. Furthermore, although no insulating material (e.g., refractory) is shown in FIGS. 7-10, it should be appreciated that an insulating material may be attached to the port door 704, and an associated aperture therein included that is aligned with the port-door aperture 710.

The multi-function sight port 700 may include any number of sensor mounts 706 thereon, and each sensor mount 706 may accommodate a single sensor 708, or any number of sensors 708 without departing from the scope hereof. The sensor(s) 708 may include any one or more of temperature sensor(s), pressure sensor(s), flame scanner(s), gas analyzer(s) (e.g., oxygen, CO, NOx, Zirconia Oxide probe, Catalytic Bead or other gas composition sensor(s)/analyzer(s)), optical-based sensors (e.g., Pyrometer(s), Camera(s)) and laser-based analyzer(s) (that detect gas composition, surface or gas temperature, and other measurement(s); such laser-based devices developed by ZOLO Technologies).

Figure 12:
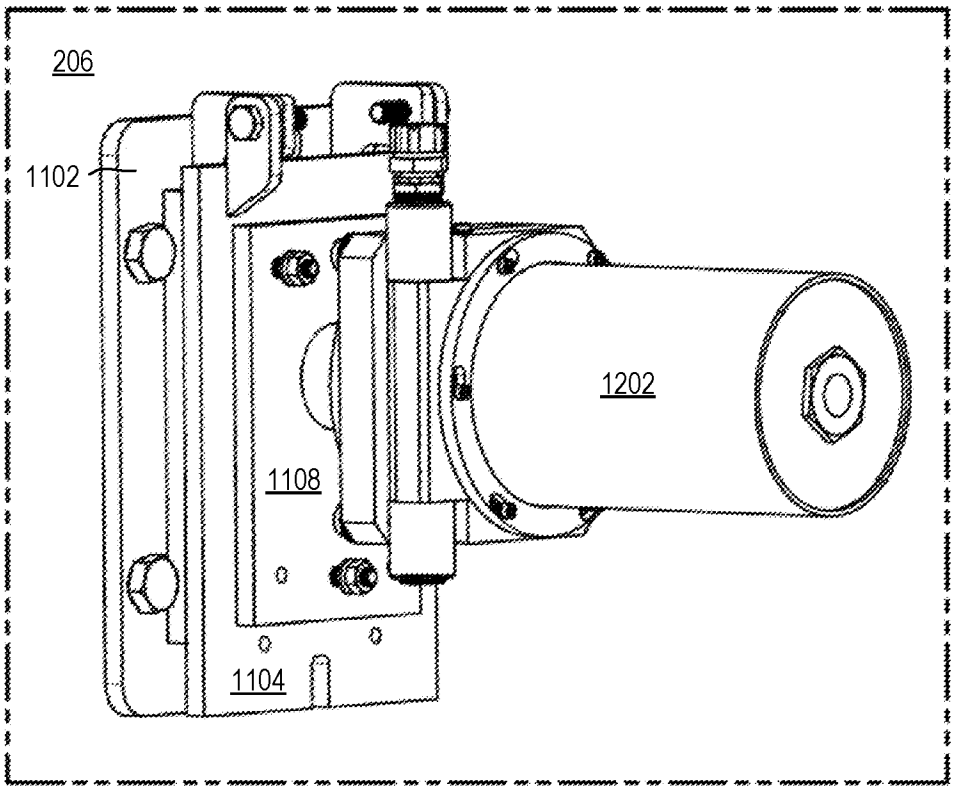
FIG. 12 depicts the multi-function sight port of FIG. 11 with a tunable diode laser (TDL) scanner head mounted to the sensor mount of FIG. 11 in a closed configuration, in an embodiment.
Figure 11:
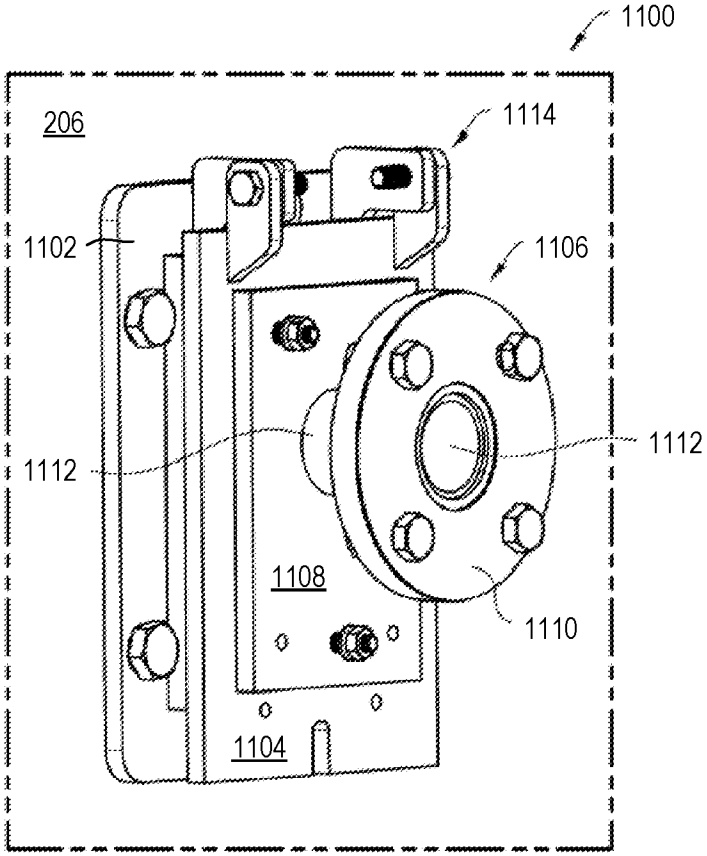
FIG. 11 depicts a multi-function sight port without a sensor mounted thereto in a closed configuration, in an embodiment.
Figure 14:
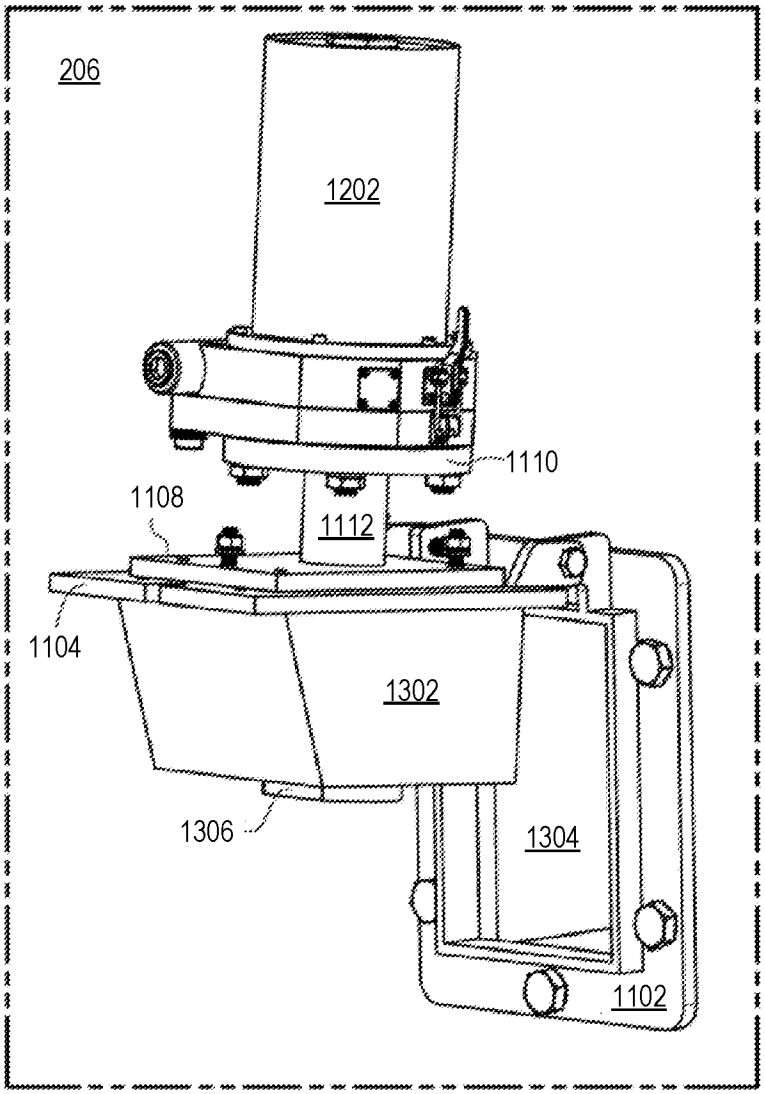
FIG. 14 depicts the multi-function sight port of FIG. 11 with the TDL laser scanner of FIG. 12 mounted thereto in the open configuration.
Figure 13:
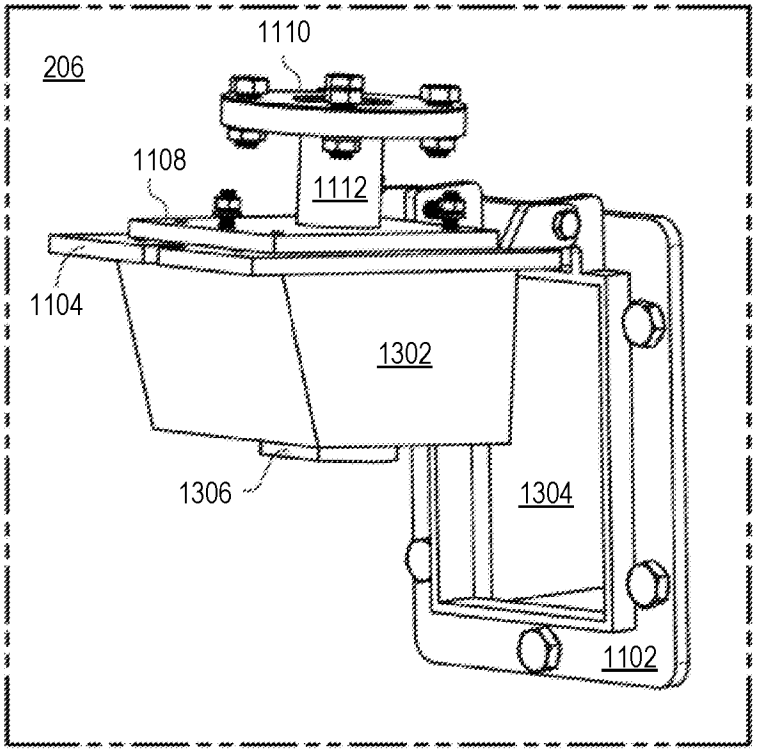
FIG. 13 depicts the multi-function sight port without the TDL laser scanner of FIG. 12 mounted thereto in an open configuration.
Figure 15:
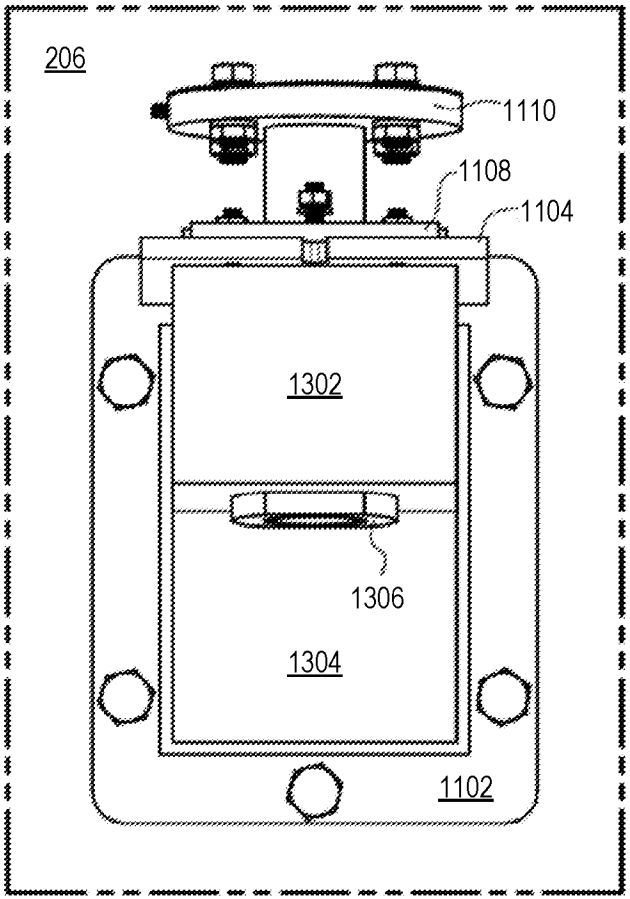
FIG. 15 depicts a front view of the configuration of FIG. 13.
Figure 16:
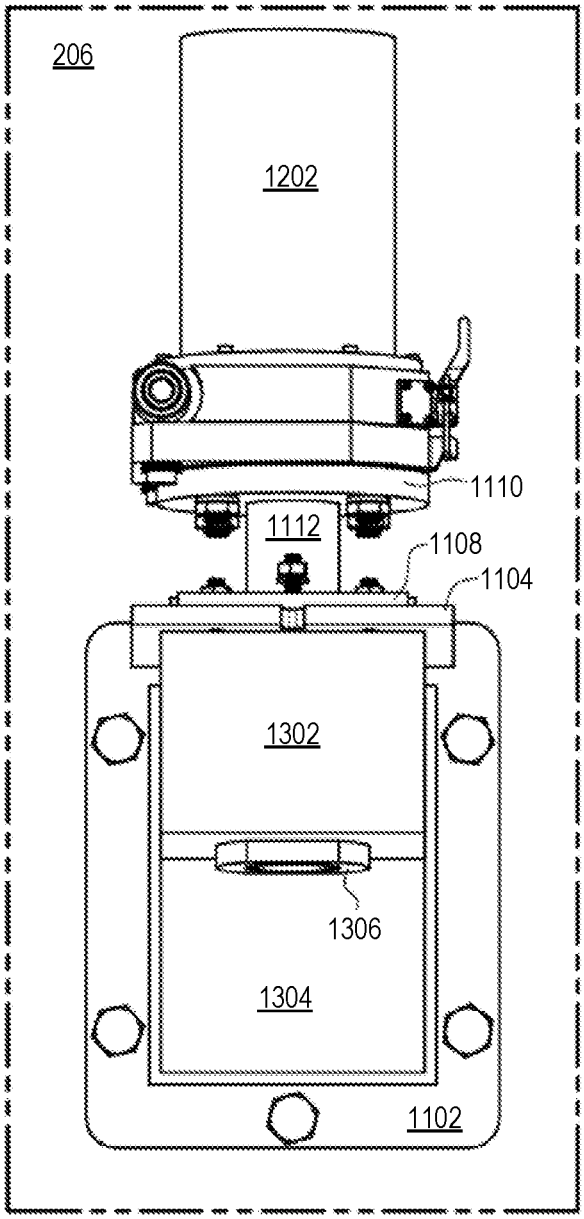
FIG. 16 depicts a front view of the configuration of FIG. 14.

FIG. 11 depicts a multi-function sight port 1100 without a sensor mounted thereto in a closed configuration, in an embodiment. FIG. 12 depicts the multi-function sight port 1100 with a tunable diode laser absorption spectroscopy (TDL) laser scanner 1200 mounted to the sensor mount 1106 in the closed configuration, in an embodiment. FIG. 13 depicts the multi-function sight port 1100 without the TDL laser scanner 1200 mounted thereto in an open configuration. FIG. 14 depicts the multi-function sight port 1100 with the TDL laser scanner 1200 mounted thereto in the open configuration. FIG. 15 depicts a front view of the configuration of FIG. 13. FIG. 16 depicts a front view of the configuration of FIG. 14. FIGS. 11-16 are best viewed together with the following description.

The multi-function sight port 1100 includes a sight port base 1102 hingedly coupled with a port door 1104. The sight port door 1104 is an example of the sight port door 704 of FIG. 7. The sight port base 1102 may be an existing sight port base (e.g., an example of the sight port base 202), particularly where the multi-function sight port 1100 is a retrofit of an existing sight port, and is coupled to the heater wall 206.

A sensor mount 1106 is coupled to the sight port door 1104. The sensor mount 1106 is shown in FIGS. 12, 14, and 16 as a mount for a TDL laser scanner 1202. The sensor mount 1106 includes a mount plate 1108 that couples to the port door 1104 and a sensor base 1110. The TDL laser scanner 1202 is removably coupled to the sensor base 1110. A sight tube 1112 is coupled to (either mechanically or integrally with) and spans between the sensor base 1110 and the mount plate 1108.

In at least some embodiments, an insulating material 1302 (e.g., refractory) is coupled to an interior side of the port door 1104. The insulating material 1302 is sized and shaped to fit within aperture 1304 of sight port base 1102 and heater wall 206. In such embodiments, the sight tube 1112 further spans the width of the insulating material 1302 and is located in an aperture within the insulating material 1302. As shown in FIG. 13, in at least some embodiments, the sensor mount 1106 further includes a mounting flange 1306 coupled to or integral with the sight tube 1112 and located on the interior side of the port door 1104, either adjacent the port door 1104 or adjacent the insulating material 1302, if included.

The port door 1104 is coupled to the sight port base 1102 via a hinge 1114. The hinge 1114 may be one or more bolts. In at least some embodiments, the hinge 1114 is spring-loaded to assist in lifting the port door 1104, and/or such that the port door 1104 stays open, or stays closed, even with the weight of the TDL laser scanner 1202. The hinge 1114 may be located on the top, bottom, or either side of the multi-function sight port 1100. The hinge 1114 may be sized and shaped to couple with existing sight port bases to allow for retrofitting thereof by replacing the existing port door with the port door of the above described multi-function sight ports. There may be a single hinge or multiple hinges without departing from the scope hereof, based on the size of the sight port base 1102 (or other sight port bases discussed with respect to other embodiments herein). Furthermore, the hinged coupling(s) may be on any edge of the sight port base 1102, allowing the sight port door 1104 to open in any direction.

In at least some embodiments, an additional lift assist device may be included to assist in opening the port door 1104 including the weight of the TDL laser scanner 1202. Furthermore, in at least some embodiments, a latch or other mechanism may be included on the port door 1104 that secures the port door 1104 in an open configuration when enacted.

In at least some embodiments, the sensor(s) 708, including the TDL laser scanner 1202 are designated Class 1 devices (e.g., "eye safe devices" that are capable of staying "on" while the port door 704 is open and the operator opening the port door 704 is within the operating field of view of the sensor 708). If the sensor 708 is not "safe" (e.g., would potentially harm the operator's eyes, or other damage, when the port door 704 is opened if the sensor 708 is still on), then there may be a disabling device (such as an electrical or mechanical sensor) that automatically turns the sensor 708 off when the port door 704 is opened. For example, a pressure switch coupled between the port door 704 and the sight port base 702 may indicate that the port door 704 is opened and automatically disable the sensor 708.

Figure 18:
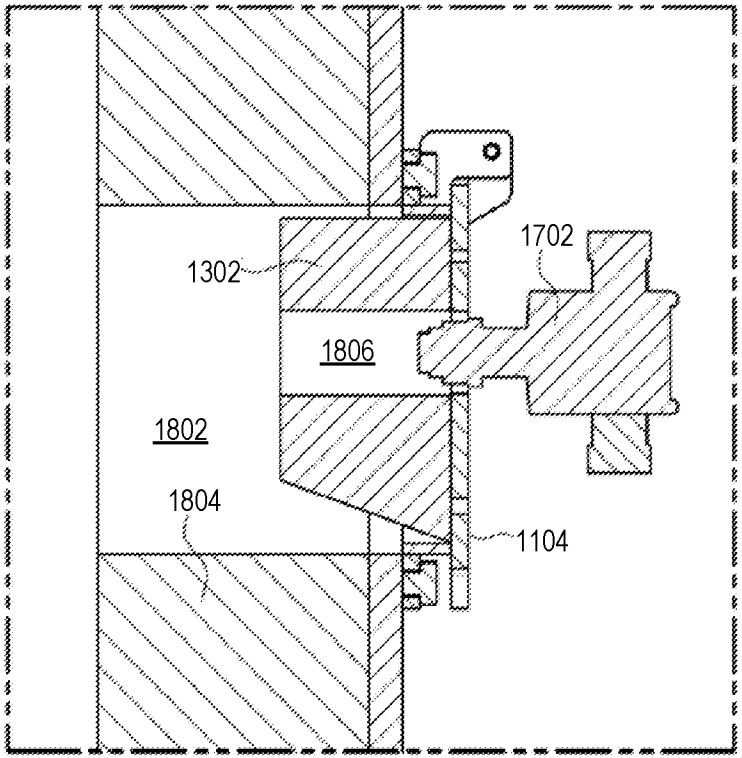
FIGS. 17-18 depict an example of the multi-function sight port of FIGS. 7-16, having a combustibles detector mounted thereon.
Figure 17:
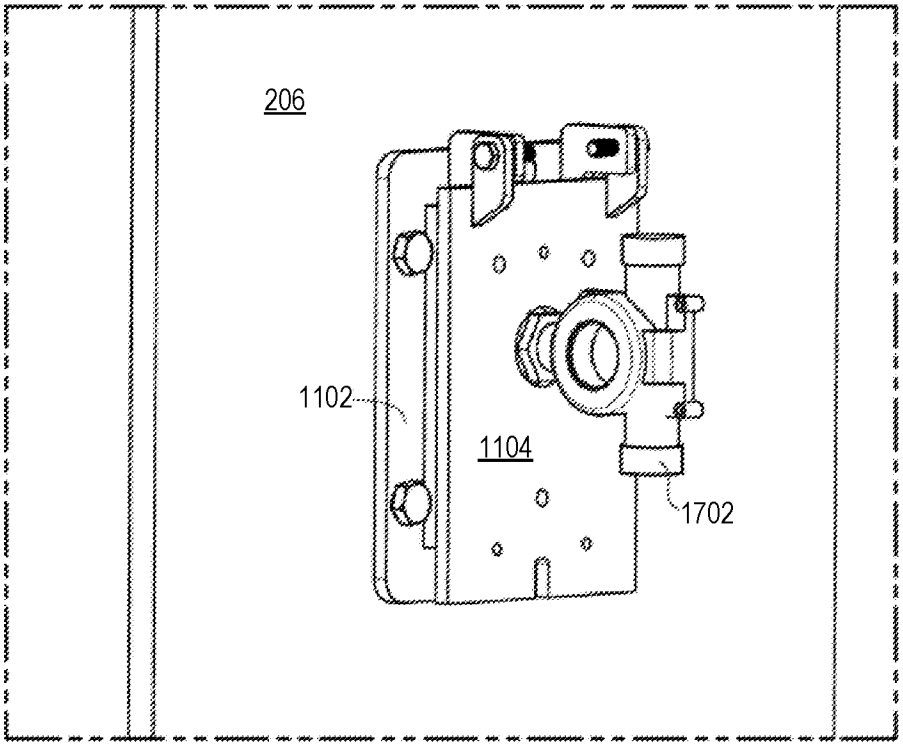

FIGS. 17-18 depict an example of the multi-function sight port 700 and 1100, of FIGS. 7-16, having a combustibles detector 1702 mounted thereon. As shown in FIG. 18, the combustibles detector 1702 couples to the sight port door 1104 and only extends partially into the aperture within insulating material 1302. Combustibles detector 1702 is for example a catalytic bead detector. Combustibles detector 1702 extracts a sample through aperture 1802 within insulating material 1804 attached to the heater wall 206, and via aperture 1806 within insulating material 1302 attached to sight port door 1104.

Figure 20:
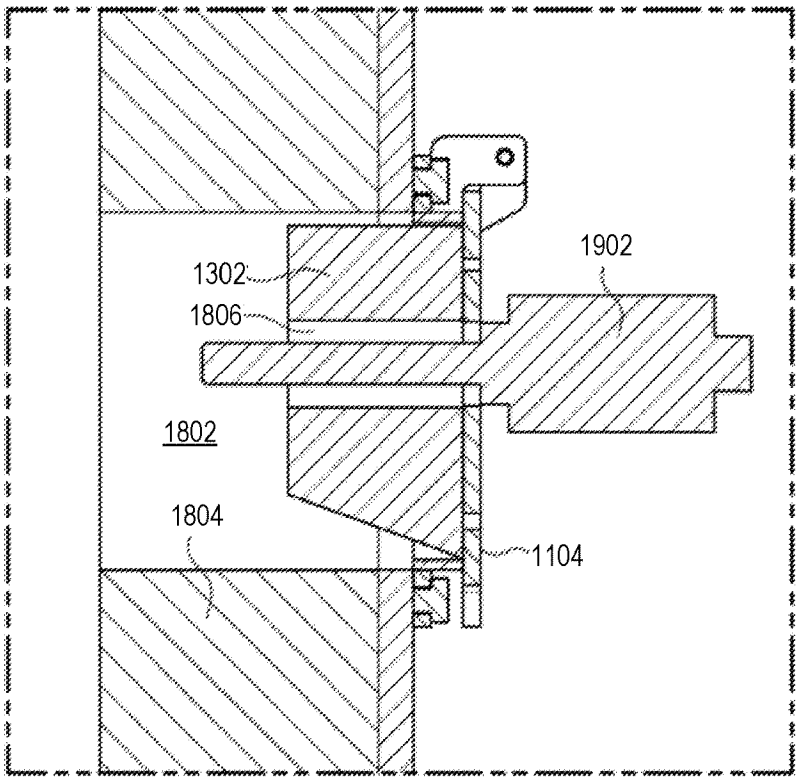
FIGS. 19-20 depict an example of the multi-function sight port of FIGS. 7-18, having an optical-based sensor mounted thereon.
Figure 19:
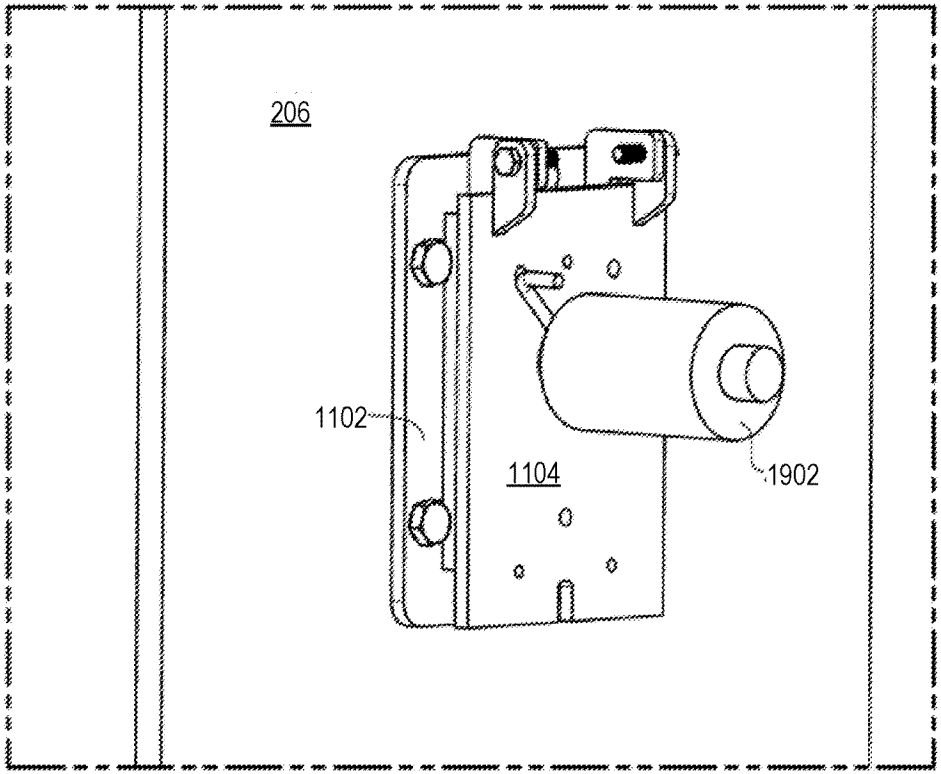

FIGS. 19-20 depict an example of the multi-function sight port 700 and 1100, of FIGS. 7-18, having an optical-based sensor 1902 mounted thereon. As shown in FIG. 20, the optical-based sensor 1902 couples to the sight port door 1104 and extends into and through the aperture within insulating material 1302. However, unlike the TDL sensor 1202, optical sensor 1902 does not include the mounting flange 1306 (although the optical-based sensor 1902 may include the mounting flange 1306 in at least some embodiments). The optical-based sensor 1902 is for example an imager, such as an infrared or visual-spectrum imager and lens or other imager components may be located interior of the insulating material 1302 from the sight port door 1104.

Figure 22:
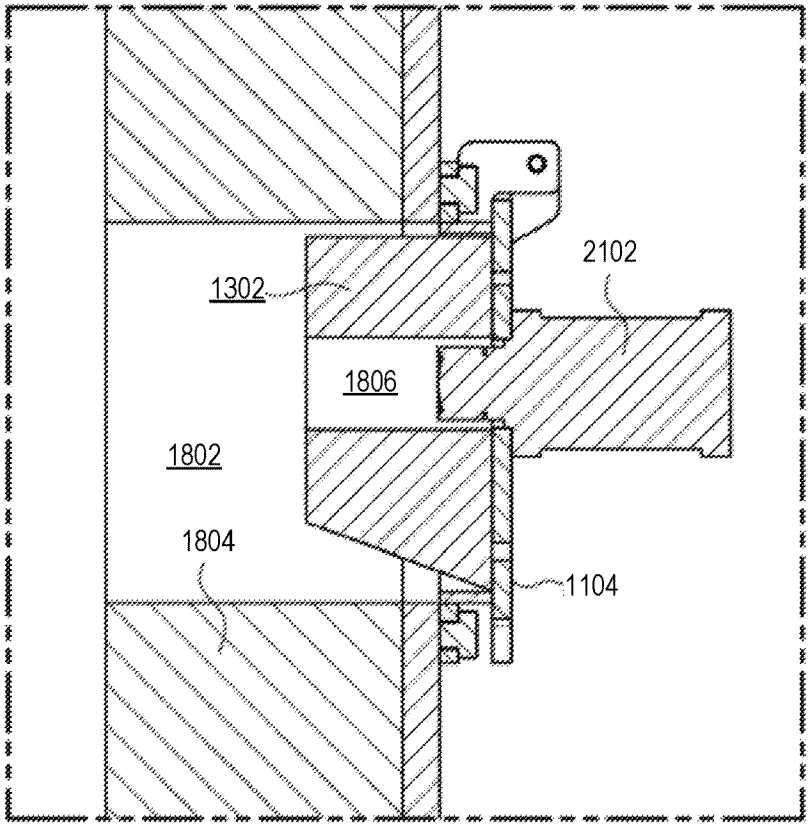
FIGS. 21-22 depicts an example of the multi-function sight port of FIGS. 7-20, having a pyrometer mounted thereon.
Figure 21:
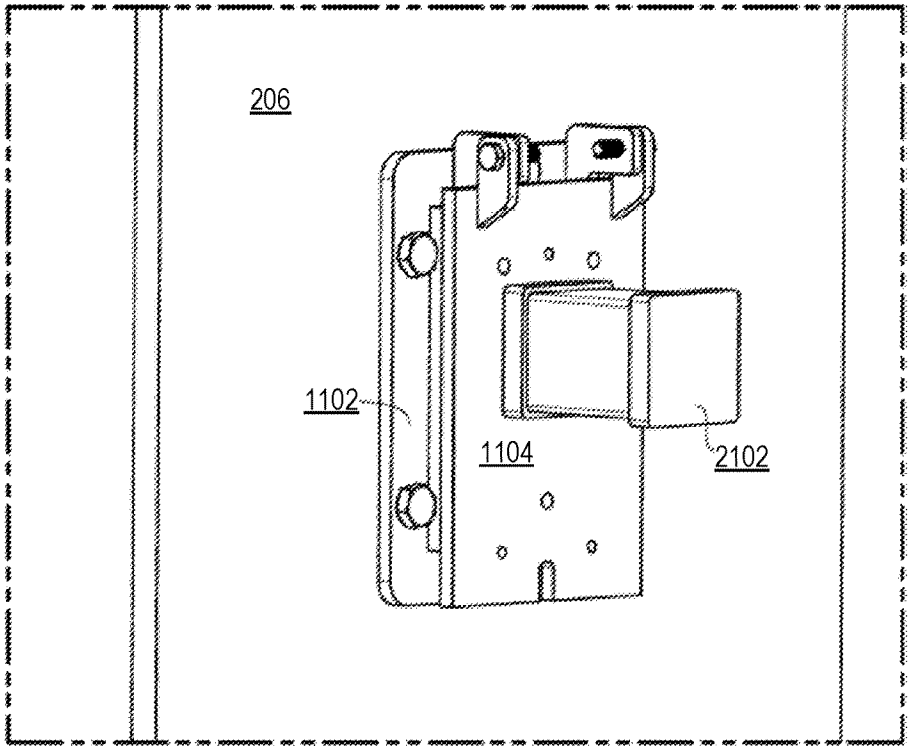

FIGS. 21-22 depicts an example of the multi-function sight port 700 and 1100, of FIGS. 7-20, having a pyrometer 2102 mounted thereon. As shown in FIG. 18, the pyrometer 2102 couples to the sight port door 1104 and only extends partially into the aperture within insulating material 1302, similar to the combustibles detector 1702.

Figure 24:
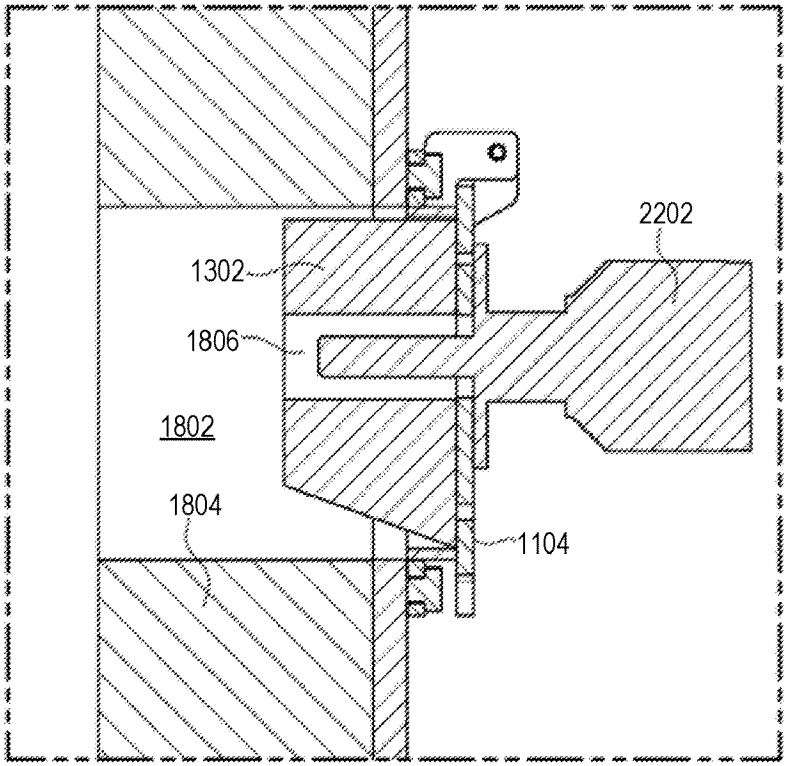
FIGS. 23-24 depict an example of the multi-function sight port of FIGS. 7-22, having an $O_2$ sensor mounted thereon.
Figure 23:
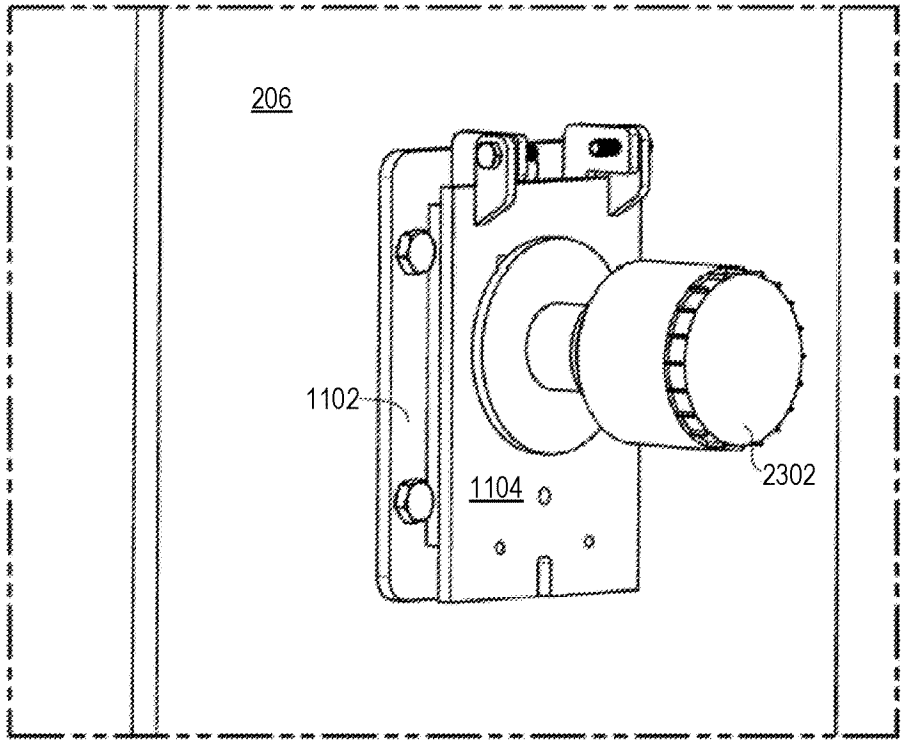

FIGS. 23-24 depict an example of the multi-function sight port 700 and 1100, of FIGS. 7-22, having an $O_2$ sensor 2302 mounted thereon. As shown in FIG. 22, the $O_2$ sensor 2302 couples to the sight port door 1104 and only extends partially into the aperture within insulating material 1302, similar to the combustibles detector 1702 and the pyrometer 2102.

Figure 26:
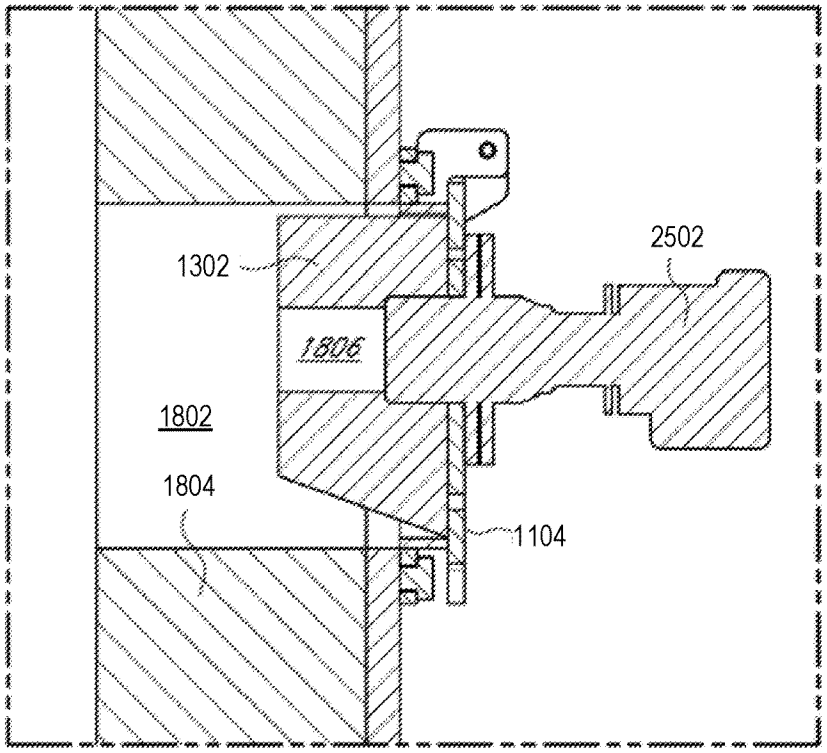
FIGS. 25-26 depict an example of the multi-function sight port of FIGS. 7-24, having another TDL laser scanner mounted thereon.
Figure 25:
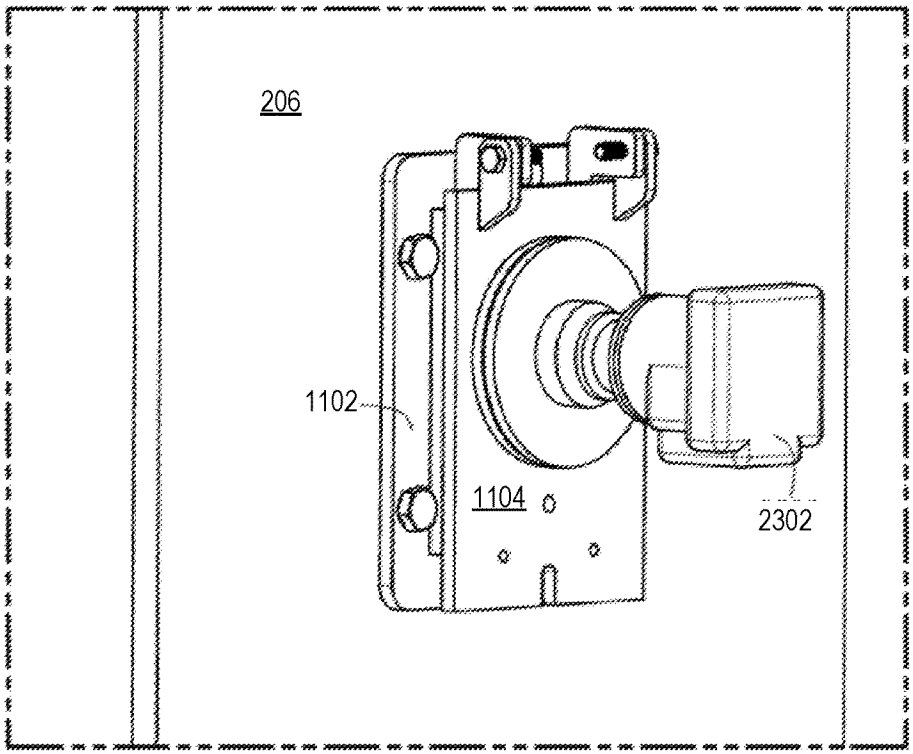

FIGS. 25-26 depict an example of the multi-function sight port 700 and 1100, of FIGS. 7-24, having another TDL laser scanner 1202 mounted thereon. As shown in FIGS. 11-26, various components of the mounting system for coupling the sensor 708 to the sight port door 704 are configurable based on the design and requirements of the sensor 708. For example, the sensor 708 may or may not extend through the insulating material 1302 coupled to the sight port door. Furthermore, the sensor mount may or may not include a mounting flange 1306 interior of the sight port door. Thus, it should be appreciated that any of the features described and/or shown with respect to FIGS. 11-26 are implemented depending on the sensor configuration.

Figure 27:
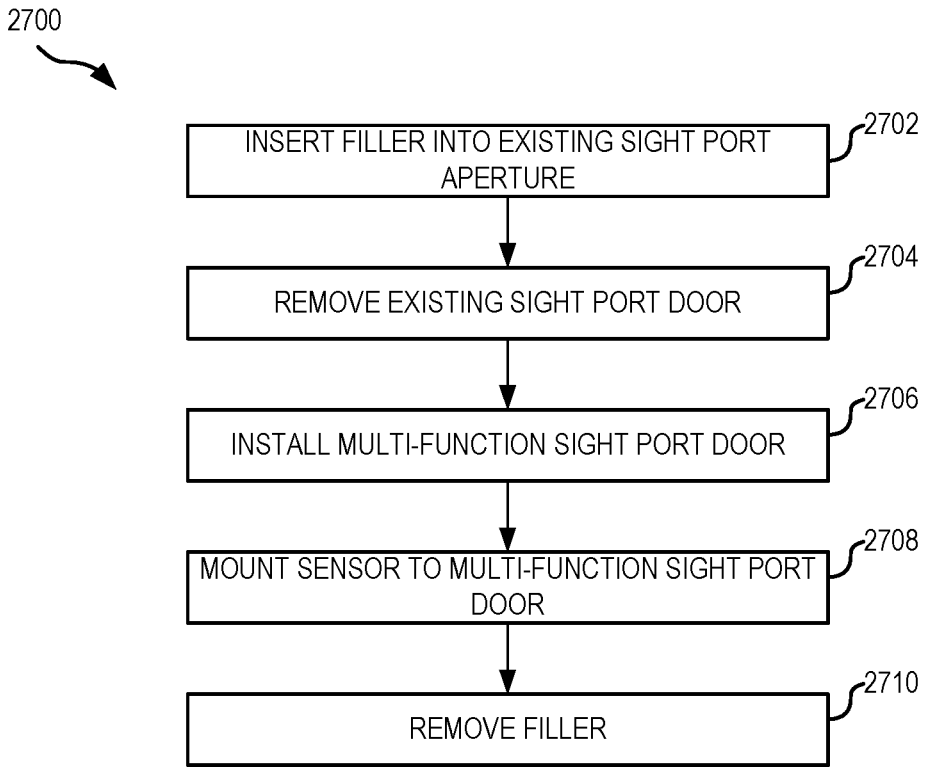
FIG. 27 depicts a method for retrofitting existing sight port with a multi-function sight port door, in an embodiment.

FIG. 27 depicts a method 2700 for retrofitting existing sight port with a multi-function sight port door, in an embodiment. Method 2700 may be implemented using the multi-function sight ports discussed above with respect to FIGS. 7-26. Method 2700 may be implemented while a heater the existing sight port is installed on is running.

In block 2702, method 2700 inserts a filler into an existing sight port aperture. In one example of block 2702, a filler, such as K-wool or other insulating material, is inserted into sight port access aperture 208 (or aperture 1304) discussed above.

In block 2704, method 2700 removes the existing sight port door. In one example of block 2704, the sight port door 204 is removed.

In block 2706, the method 2700 installs a multi-function sight port door. In one example of block 2706, the multi-function sight port door 704 (or sight port door 1104) are installed on the existing sight port base 202 (or sight port base 1102).

In block 2708, the method 2700 installs a sensor onto the multi-function sight port door installed in block 2706. In one example of block 2708, the TDL laser scanner 1202, or any other sensor described above with respect to FIGS. 11-26 (or otherwise known in the art), is installed on sensor mount 1106 or directly to the sight port door 1104.

In block 2710, the method 2700 removes the filler inserted in block 2702.

Figure 28:
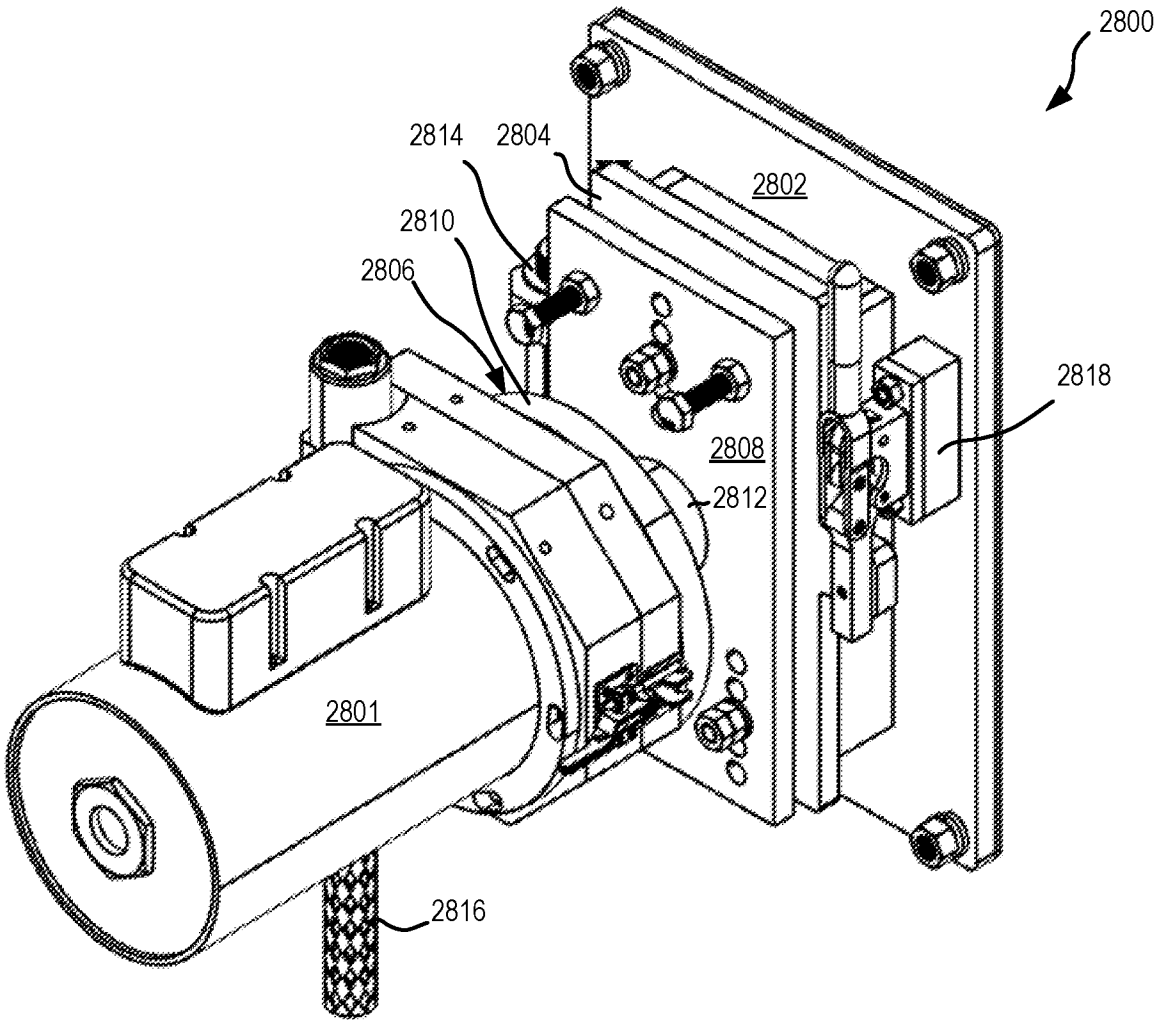
Figure 29:
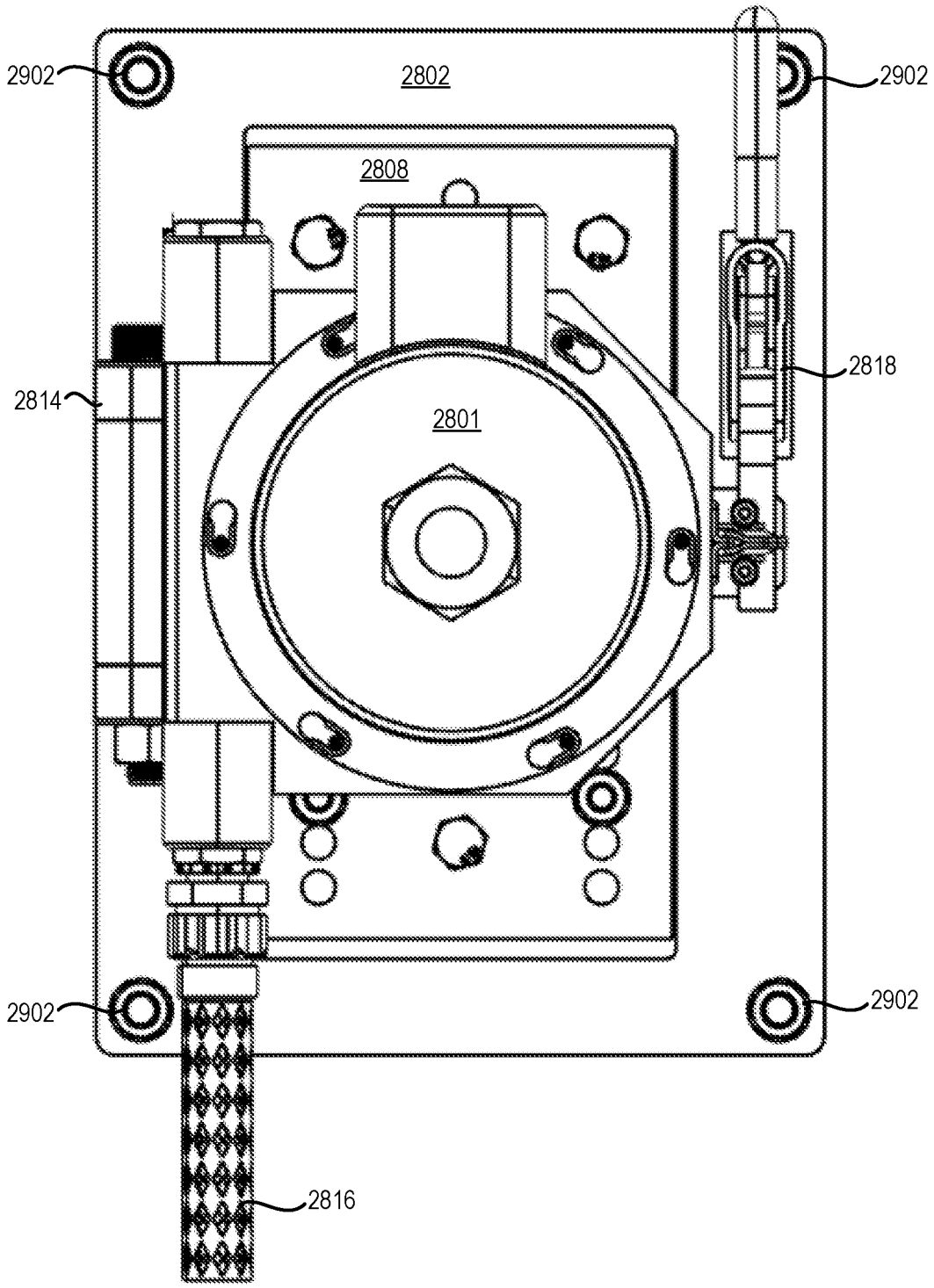
Figure 30:
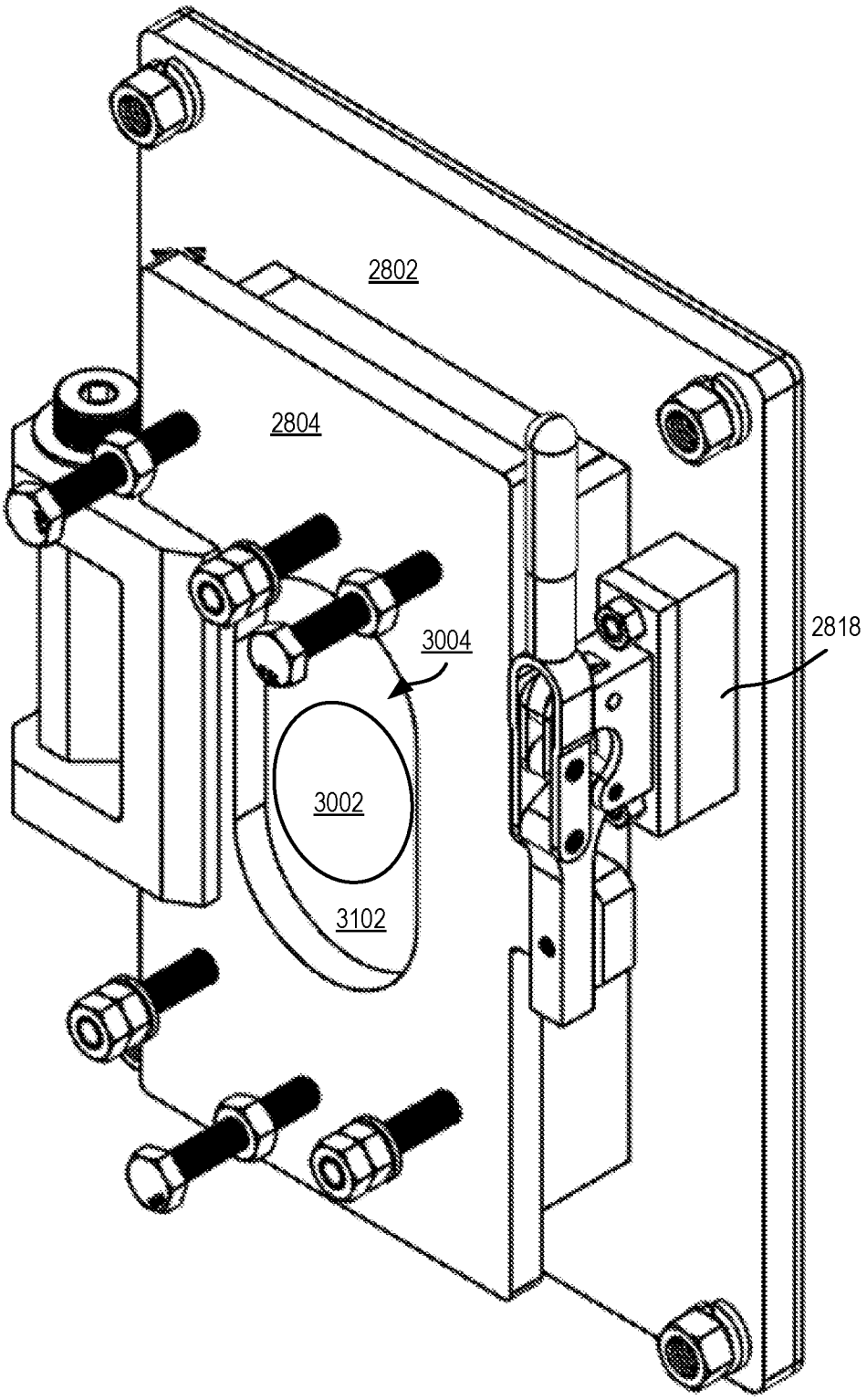
Figure 31:
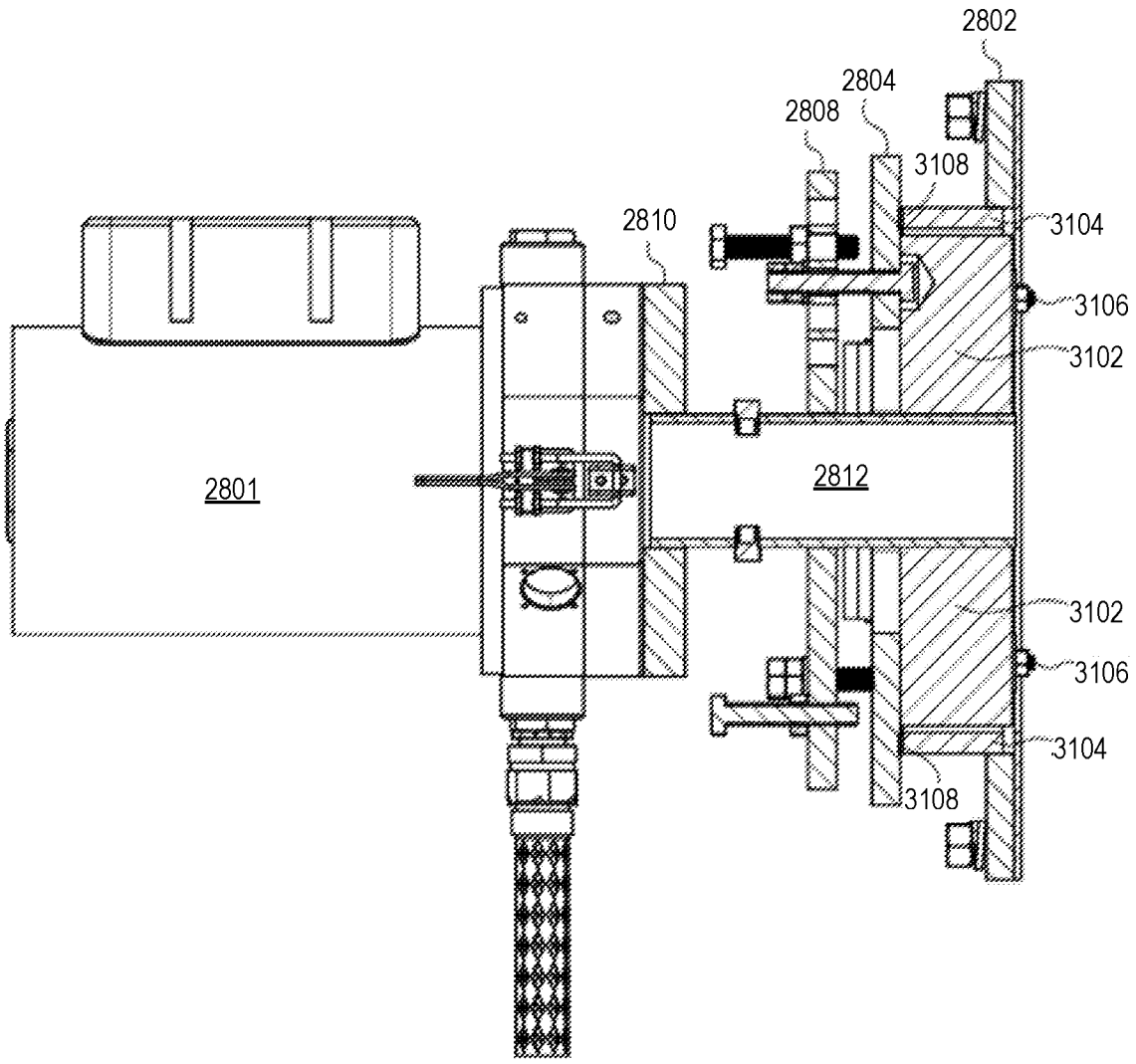
Figure 32:
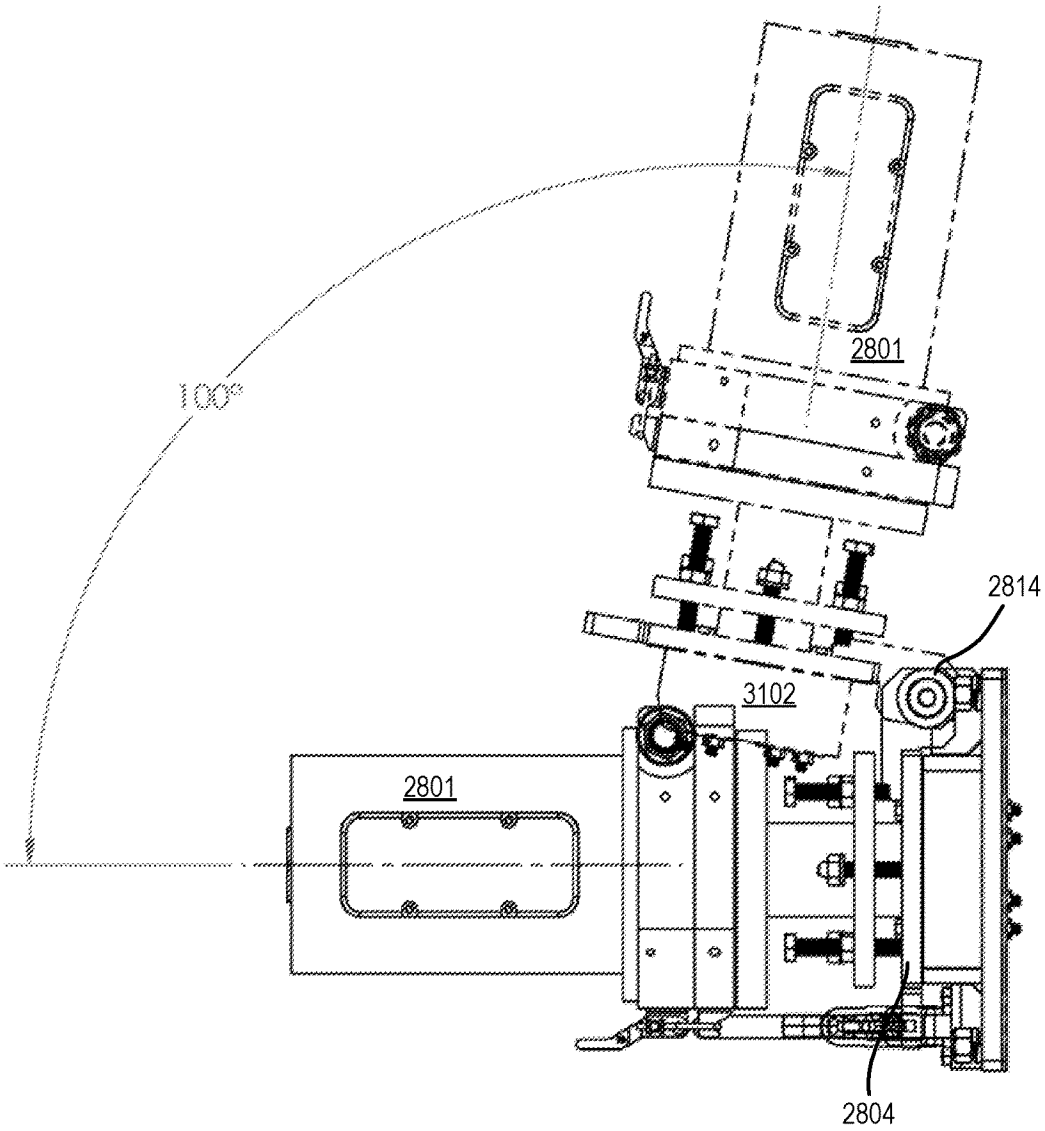
Figure 33:
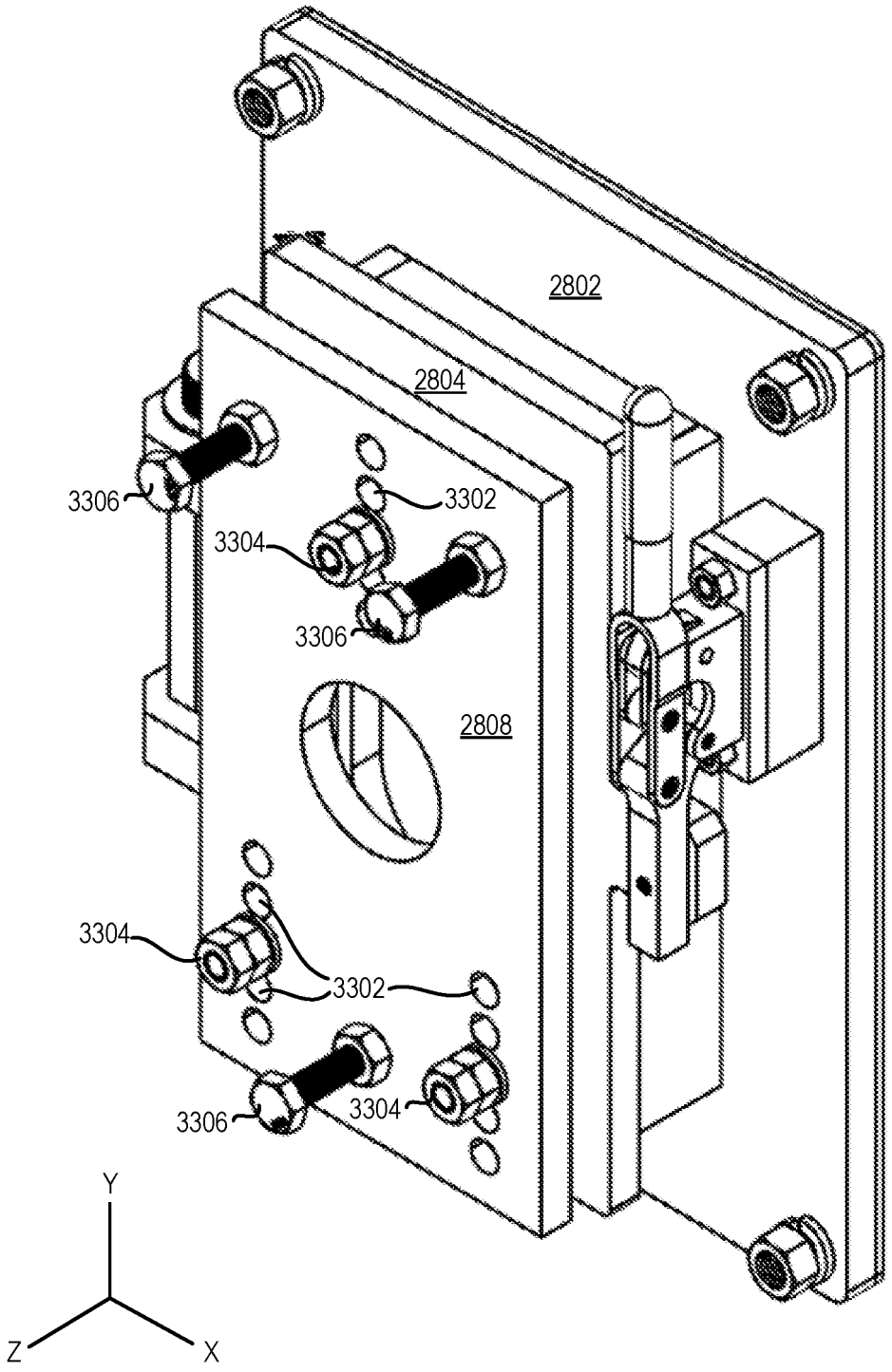

FIG. 28 depicts a perspective view of an example of a multi-function sight port 2800, showing additional features, in an embodiment. FIG. 29 depicts a front view of the multi-function sight port 2800. FIG. 30 depicts a perspective view of the sight port base and sight port door, with other components hidden for clarity. FIG. 31 depicts a sectional view of the sight port base and sight port door, with the sensor shown not in sectional view. FIG. 32 shows advantageous opening range of the multi-function sight port 2800. FIG. 33 depicts a perspective view of the sight port base, sight port door, and mount plate with other components hidden for clarity FIGS. 28-33 are best viewed together with the following descriptions. The additional features discussed below are combinable with any of the multi-function site ports discussed above (e.g., multi-function sight port 700, 1100) without departing from the scope hereof.

The multi-function sight port 2800 includes a sight port base 2802 hingedly coupled with a port door 2804. The sight port door 2804 is an example of the sight port door 704 of FIG. 7 and 1104 of FIG. 11. The sight port base 2802 may be an existing sight port base (e.g., an example of the sight port base 202), particularly where the multi-function sight port 2800 is a retrofit of an existing sight port, and is coupled to the heater wall 206.

A sensor mount 2806 is coupled to the sight port door 2804. The sensor mount 2806 is an example of the sensor mount 1106 of FIG. 11, and may mount any of the sensors of FIGS. 11-26. The sensor mount 2806 is shown in FIGS. 28-33 as a mount for a sensor 2801, which is shown as a TDL laser scanner, which is similar to the TDL laser scanner 1202 discussed above. The sensor mount 2806 includes a mount plate 2808 that couples to the port door 2804 and a sensor base 2810. The sensor 2801 is removably coupled to the sensor base 2810. A sight tube 2812 is coupled to (either mechanically or integrally with) and spans between the sensor base 1110 and the mount plate 1108.

As illustrated in FIG. 31, in at least some embodiments, an insulating material 3102 (e.g., refractory) is coupled to an interior side of the port door 2804. The insulating material 3102 is sized and shaped to fit within an aperture, defined at the interior of walls 3104 of the sight port base 2802 and heater wall 206. In such embodiments, the sight tube 2812 further spans the width of the insulating material 3102 and is located in an aperture within the insulating material 3102. FIG. 30 depicts aperture 3002 within insulating material 3102. Aperture 3002 within insulating material 3102 may the same shape and size as an aperture 3004 within sight port door 2804 (as shown in FIG. 29), or may be different shape and/or size. The aperture 3002 may be created on-site (e.g., to match the desired shape and configuration of the attached sensor 2801 and sight tube 2812) during installation of the multi-function sight port 2800, whereas the aperture 3004 within sight port door 2804 may be a standard size and shape.

The insulating material 3102 is shown secured to the sight port door 2804 via one or more fasteners 3106. Alternatively, or additionally, although not shown in FIGS. 28-33 in at least some embodiments, the sensor mount 2806 further includes a mounting flange (e.g., mounting flange 1306) coupled to or integral with the sight tube 2812 and located on the interior side of the port door 2804, either adjacent the port door 2804 or adjacent the insulating material 3102, if included.

Also shown in FIG. 31, a gasket 3108 may be located between the sight port door 2804 and the sight port base 2802. The gasket 3108 may be any material capable of withstanding the operating conditions of the multi-function sight port door, including but not limited to ceramic, and ceramic fiber braid. The gasket 3108 removes any air gaps that would potentially be present via the metal-to-metal contact of the sight port door 2804 with the walls 3104.

The sight port base 2802 is coupled to the heater housing via one or more fasteners 2902. The port door 2804 is coupled to the sight port base 2802 via a hinge 2814. The hinge 2814 may include one or more bolts. In at least some embodiments, the hinge 2814 is spring-loaded to assist in lifting the port door 2804, and/or such that the port door 2804 stays open, or stays closed, even with the weight of the sensor 2801. The hinge 2804 may be located on the top, bottom, or either side of the multi-function sight port 2800. The hinge 2814 may be sized and shaped to couple with existing sight port bases to allow for retrofitting thereof by replacing the existing port door with the port door of the above described multi-function sight ports. There may be a single hinge or multiple hinges without departing from the scope hereof, based on the size of the sight port base 2802 (or other sight port bases discussed with respect to other embodiments herein). Furthermore, the hinged coupling(s) may be on any edge of the sight port base 2802, allowing the sight port door 2804 to open in any direction. The hinge 2814 is shown as an off-set hinge where, as shown in FIG. 32, the hinge 2814 allows for extended range of opening such that the operator has better visibility into the heater when using the sight port door 2804 to view into the heater. FIG. 32 shows a 100-degree range of opening, but greater or lesser angular range may be achieved depending on the configuration of the hinge 2814.

In at least some embodiments, an additional lift assist device may be included to assist in opening the port door 2804 including the weight of the sensor 2801. Furthermore, in at least some embodiments, a latch or other mechanism may be included on the port door 2804 and the heater housing that secures the port door 2804 in an open configuration when enacted. A handle 2816 is shown attached to the sensor 2801, but it may be attached to a portion of the sight port door 2804 without departing from the scope hereof.

The multi-function sight port 2800 is further shown with a clamp 2818 to secure the port door 2804 in a closed position. The clamp 2818 may be a steel hold-down clamp, or other type of clamp, that achieves a consistent and repeatable pressure to maintain the sight port door 2804 in a consistent and repeatable position when closed. This provides the advantage, particularly when the sensor 2801 is a laser-based system, of providing a consistent position of the sensor 2801 when the port door 2804 is closed thereby allowing for consistent operating configuration of the sensor 2801.

The multi-function sight port 2800 may be configured to allow for one or more of X-axis, Y-axis, Z-axis, tilt, roll, and yaw positioning of the sensor as mounted to the sight port door 2804. FIG. 33 shows a plurality of apertures 3302 that allow translation of the sensor 2801 along a Y-axis. There may be additional or alternative apertures (not shown) that are adjacent one or more of the apertures 3302 that allow translation of the sensor 2801 along the X-axis. Rotation about the Z-axis of the sensor 2801 may occur using arced apertures (as opposed to the circular apertures shown in FIG. 33) that allow rotation of the mounting plate about the Z-axis (i.e., "roll"). The mounting plate 2808 is coupled to the sight port door 2804 via one or more translation fasteners 3304 each respectively passing through one of the apertures 3302. Rotation about the Y-axis (i.e., "Yaw") and rotation about the X-axis (i.e. "pitch") may be set via orientation fasteners 3306. Orientation fasteners 3306 interact with the sight port door 2804 to manipulate the mounting plate 2808.

Ability of one or more of X-axis, Y-axis, Z-axis, tilt, roll, and yaw positioning of the sensor is advantageous, particularly where the sensor 2801 is a laser-0based sensor. The emitted laser may be required to hit a reflector, or be received by a catch head on an opposing wall of the heater. By allowing for one or more of X-axis, Y-axis, Z-axis, tilt, roll, and yaw positioning of the sensor 2801, the multi-function sight port enables accurate alignment with the reflector or catch head. When combined with the clamp 2818, as discussed above, not only is this alignment achievable, but it is repeatable throughout use of the multi-function sight port to visually inspect the heater.

The multi-function sight port 2800 may include features described above with respect to FIGS. 6-26 without departing from the scope hereof. For example, multiple sensors mounted to the sensor mount 2808. As another example, the disabling device discussed above may be a component of the multi-function sight port 2800.

Figure 34:
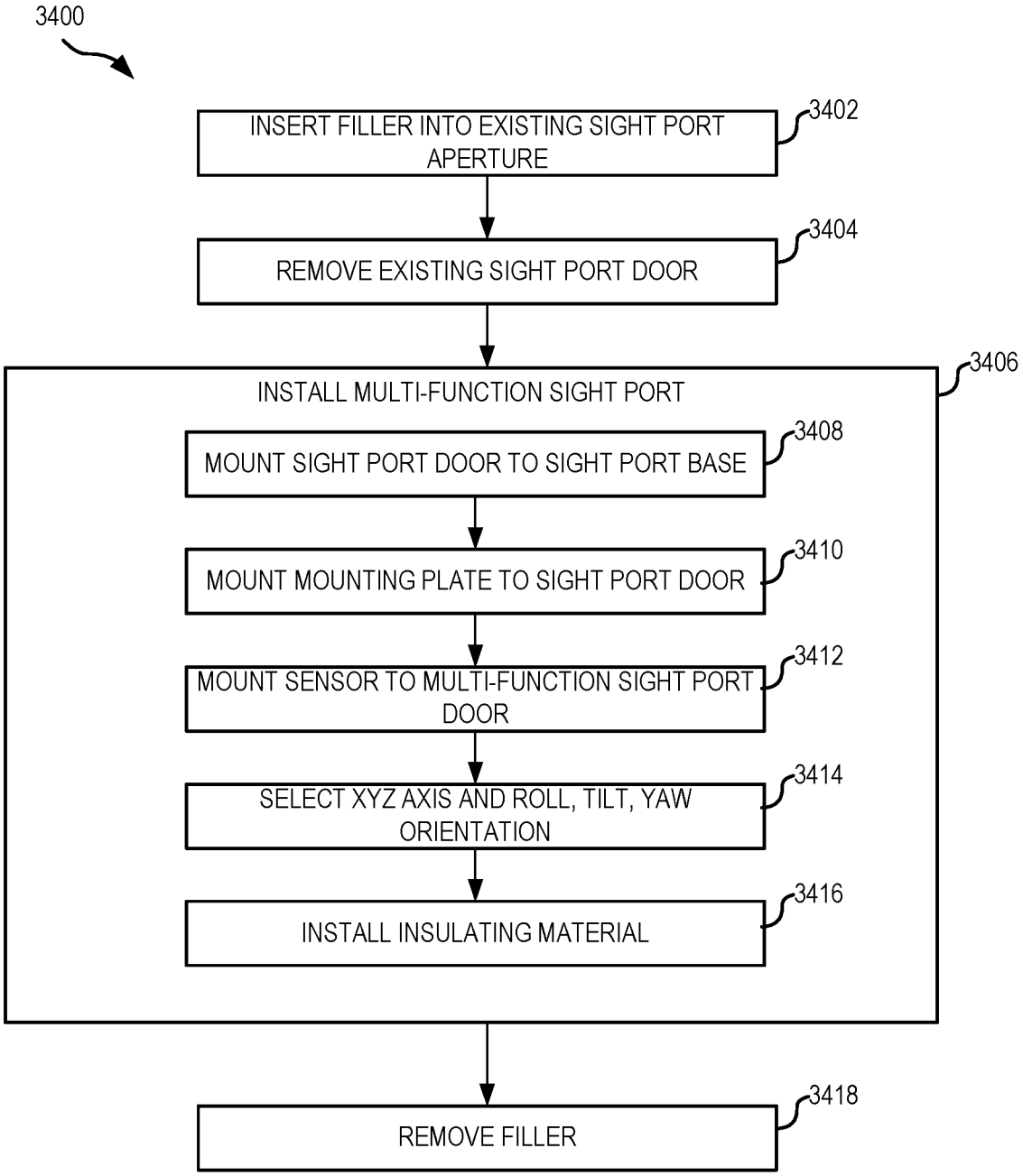

FIG. 34 depicts a method 3400 for retrofitting existing sight port with a multi-function sight port door, in an embodiment. Method 3400 is similar to method 2700, discussed above, but includes additional features described with respect to FIGS. 28-33. Thus, method 3400 may be implemented using the multi-function sight ports discussed above with respect to FIGS. 28-33 (and any of the sensors described with respect to FIGS. 7-26). Method 3400 may be implemented while a heater the existing sight port is installed on is running.

In block 3402, method 3400 inserts a filler into an existing sight port aperture. In one example of block 3402, a filler, such as K-wool or other insulating material, is inserted into sight port access aperture 208 (or aperture 1304) discussed above.

In block 3404, method 3400 removes the existing sight port door. In one example of block 3404, the sight port door 204 is removed.

In block 3406, the method 2700 installs a multi-function sight port. In one example of block 3406, the multi-function sight port 2800 is installed on the heater. Block 3406 may implement one or more of the following sub-blocks.

In sub-block 3408 a sight port door is mounted to a sight port base. In one example, the sight port door 2804 is installed on an existing sight port base 202. In another example, a new sight port base 2802 is installed in place of the existing sight port base 202. Block 3408 may include utilizing hinge 2814 that allows for greater than 90-degree opening range (e.g., 100 degrees as shown in FIG. 32).

In sub-block 3410, a mounting plate is mounted to the sight port door. In one example of sub-block 3410, mounting plate 2808 is secured to sight port door 2804 using one or more of translation fasteners 3304 and orientation fasteners 3306.

In sub-block 3412, a sensor is mounted to the mounting plate. In one example of sub-block 3412, sensor 2801 is secured to mounting plate 2808.

In sub-block 3414, one or more of X-axis translation, Y-axis translation, Z-axis translation, tilt, roll, and yaw of the sensor is selected. In one example of sub-block 3414, the mounting plate 2808 and sensor 2801 are configured along one or more of X-axis, Y-axis, Z-axis, tilt, roll, and yaw using one or more of translation fasteners 3304 and orientation fasteners 3306.

In sub-block 3416, insulating material is installed on the sight port door. In one example of operation of sub-block 3416, insulating material 3102 is installed onto sight port door using fasteners 3106. In another example of operation of sub-block 3416 a mounting flange (similar to mounting flange 1306) is additionally or alternatively used to secure insulating material 3102 to the sight port door 2804. Sub-block 3416 may include creating aperture 3002 on-site (e.g., to match the desired shape and configuration of the attached sensor 2801 and sight tube 2812).

In block 3418, the method 3400 removes the filler inserted in block 3402.

The above-described multi-function sight ports allow for visual inspection interior the heater, when the port door is opened, as well as sensor-based inspection interior the heater via the same hardware. Furthermore, the above-described multi-function sight port allows for installation of the hardware without requiring turndown of the heater system, thereby reducing maintenance time and increasing profits made because the system does not need to shut down.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

Combination of Features:

Features described above as well as those claimed below may be combined in various ways without departing from the scope hereof. The following examples illustrate possible, non-limiting combinations of features and embodiments described above. It should be clear that other changes and modifications may be made to the present embodiments without departing from the spirit and scope of this invention:

(A1) In a first aspect, a multi-function sight port system for monitoring an interior of a heater, includes: a sight port base; and a sight port door coupled to the sight port base, the sight port door having a sensor mount attached at an aperture of the sight port door, the sensor mount configured to allow a sensor to monitor the interior of the heater.

(A2) In the multi-function sight port system of (A1), the system further includes a hinge to hingedly mount the sight port door to the sight port base.

(A3) In either the multi-function sight port system of (A1)-(A2), the hinge being offset and allowing opening of the sight port door at least 100 degrees.

(A4) In any of the multi-function sight port systems of (A1)-(A3), the sight port door being configured to install to the sight port base without turndown of the heater.

(A5) In any of the multi-function sight port systems of (A1)-(A4), the system further includes at least one sensor mounted to the sensor mount.

(A6) In any of the multi-function sight port systems of (A1)-(A5), the at least one sensor including at least one sensor selected from the group of sensors including temperature sensor, pressure sensor, flame scanner, gas analyzer, optical-based sensor, thermal imager, thermal camera, and laser-based analyzer.

(A7) In any of the multi-function sight port systems of (A1)-(A6), the sensor mount including a plurality of sensor mounts each coupled to a respective sensor.

(A8) In any of the multi-function sight port systems of (A1)-(A7), the system further including insulating material attached to the sight port door.

(A9) In any of the multi-function sight port systems of (A1)-(A8), the insulating material being refractory mounted to the sight port door via fasteners.

(A10) In any of the multi-function sight port systems of (A1)-(A9), the insulating material being refractory mounted to the sight port door via a mounting flange.

(A11) In any of the multi-function sight port systems of (A1)-(A10), the sensor mount including: a mounting plate coupled to the sight port door; a sensor base, the sensor removably coupled to the sensor base; and, a sight tube spanning between the mount plate and the sensor base.

(A12) In any of the multi-function sight port systems of (A1)-(A11), the sensor mount further including a mounting flange on the interior side of the sight port door.

(A13) In any of the multi-function sight port systems of (A1)-(A12), the system further including refractory located at least partially between the mount flange and the sight port door.

(A14) In any of the multi-function sight port systems of (A1)-(A13), the sight tube spanning between the mount flange and the sensor mount.

(A15) In any of the multi-function sight port systems of (A1)-(A14), the sensor being a tunable diode laser absorption spectroscopy (TDL) system.

(A16) In any of the multi-function sight port systems of (A1)-(A15), the sensor mount including: a mounting plate coupled to the sight port door via one or more of translation fasteners and orientation fasteners.

(A17) In any of the multi-function sight port systems of (A16), the translation fasteners providing translation of the mounting plate along at least one of an X-axis, Y-axis, and Z-axis with respect to the sight port door.

(A18) In any of the multi-function sight port systems of (A16)-(A17), the orientation fasteners providing configuration of tilt, roll, and yaw of the mounting plate with respect to the sight port door.

(A19) In any of the multi-function sight port systems of (A1)-(A18), the system further including a lift-assist mechanism that aids in opening the sight port door.

(A20) In any of the multi-function sight port systems of (A1)-(A19), a hinge coupling the sight port door to the sight port base being a spring-loaded hinge.

(A21) In any of the multi-function sight port systems of (A1)-(A20), the system further including a latch configured to retain the sight port door in an open configuration.

(A22) In any of the multi-function sight port systems of (A21), the latch being a steel hold-down clamp.

(A23) In any of the multi-function sight port systems of (A1)-(A22), the system further including a disabling device configured to disable the sensor when the sight port door is in an open configuration.

(A24) In any of the multi-function sight port systems of (A1)-(A23), a gasket between the sight port door and the sight port base.

(A25) In any of the multi-function sight port systems of (A25), the gasket being a ceramic braid gasket.

(B1) In a second aspect, a method for retrofitting a sight port, includes: removing an existing sight port door; installing a multi-function sight port door.

(B2) In the method of (B1), the method further includes inserting a filler into an existing sight port aperture.

(B3) In either method of (B1)-(B2), the method further including installing a sensor onto a sensor mount of the multi-function sight port door.

(B4) In any of the methods of (B1)-(B3), the method being performed while a heater to which the sight port is installed is running.

(B5) In any of the methods of (B1)-(B4), the installing a multi-function sight port door including mounting the sight port door to a sight port base via a hinge.

(B6) In any of the methods of (B5), the hinge being offset to allow for opening of the sight port door at least 100 degrees (B7) In any of the methods of (B1)-(B6), the method further including mounting a mounting plate to the sight port door, the mounting plate configured to mount a sensor thereto.

(B8) In any of the methods of (B7), the mounting a mounting plate including securing the mounting plate with one or more of translation fasteners and orientation fasteners.

(B9) In any of the methods of (B8), the translation fasteners providing translation of the mounting plate along at least one of an X-axis, Y-axis, and Z-axis with respect to the sight port door.

(B10) In any of the methods of (B8)-(B9), the orientation fasteners providing configuration of tilt, roll, and yaw of the mounting plate with respect to the sight port door.

(B11) In any of the methods of (B1)-(B3), the method further including securing the sight port door in a closed position using a steel hold-down clamp.

(B12) In any of the methods of (B1)-(B11), the method further including installing any of the features described in the embodiments (A1)-(A25) of the first aspect.

What is claimed is:

1. A multi-function sight port system for monitoring an interior of a heater, comprising:

a sight port base;

a sight port door coupled to the sight port base, the sight port door having a sensor mount attached at an aperture of the sight port door, the sensor mount configured to allow a sensor to monitor the interior of the heater; and a mounting plate of the sensor mount configured to allow for one or more of X-axis, Y-axis, Z-axis, tilt, roll, and yaw positioning of the sensor, the mounting plate being coupled to the sight port door via one or more of translation fasteners and orientation fasteners.

2. The multi-function sight port system of claim 1, further comprising a hinge to hingedly mount the sight port door to the sight port base.

3. The multi-function sight port system of claim 2, the hinge being offset and allowing opening of the sight port door at least 100 degrees.

4. The multi-function sight port system of claim 1, the sight port door configured to install to the sight port base without turndown of the heater.

5. The multi-function sight port system of claim 1, further comprising at least one sensor mounted to the sensor mount.

6. The multi-function sight port system of claim 1, the sensor being selected from a group consisting of: a temperature sensor, a pressure sensor, a flame scanner, a gas analyzer, an optical-based sensor, a thermal imager, a thermal camera, and a laser-based analyzer.

7. The multi-function sight port system of claim 1, further comprising insulating material attached to the sight port door.

8. The multi-function sight port system of claim 7, the insulating material being refractory mounted to the sight port door via fasteners.

9. The multi-function sight port system of claim 7, the insulating material being refractory mounted to the sight port door via a mounting flange.

10. The multi-function sight port system of claim 1, the sensor mount comprising:

the mounting plate, the mounting plate being coupled to the sight port door;

a sensor base, the sensor removably coupled to the sensor base; and, a sight tube spanning between the mount plate and the sensor base.

11. The multi-function sight port system of claim 10, the sensor mount further comprising a mounting flange on an interior side of the sight port door.

12. The multi-function sight port system of claim 11, further comprising refractory located at least partially between the mount flange and the sight port door.

13. The multi-function sight port system of claim 12, the sight tube spanning between the mount flange and the sensor mount.

14. The multi-function sight port system of claim 10, the sensor being a tunable diode laser absorption spectroscopy (TDL) system.

15. The multi-function sight port system of claim 1, wherein the mounting plate is coupled to the sight port door via one or more of the translation fasteners, the translation fasteners providing translation of the mounting plate along at least one of an X-axis, Y-axis, and Z-axis with respect to the sight port door.

16. The multi-function sight port system of claim 1, wherein the mounting plate is coupled to the sight port door via one or more of the orientation fasteners, the orientation fasteners providing configuration of tilt, roll, and yaw of the mounting plate with respect to the sight port door.

17. The multi-function sight port system of claim 1, further comprising a lift-assist mechanism that aids in opening the sight port door.

18. The multi-function sight port system of claim 1, a hinge coupling the sight port door to the sight port base being a spring-loaded hinge.

19. The multi-function sight port system of claim 1, further comprising a latch configured to retain the sight port door in an open configuration.

20. The multi-function sight port system of claim 19, the latch being a steel hold-down clamp.

21. The multi-function sight port system of claim 1, further comprising a disabling device configured to disable the sensor when the sight port door is in an open configuration.

22. The multi-function sight port system of claim 1, further comprising a gasket between the sight port door and the sight port base.

23. The multi-function sight port system of claim 22, the gasket being a ceramic braid gasket.

24. A method for retrofitting a sight port, comprising:

removing an existing sight port door;

installing a multi-function sight port door, the multi-function sight port door comprising:

a sight port base;

a sight port door coupled to the sight port base, the sight port door having a sensor mount attached at an aperture of the sight port door, the sensor mount configured to allow a sensor to monitor an interior of a heater;

a mounting plate of the sensor mount having a sensor mounted thereto, the mounting plate being configured to allow for one or more of X-axis, Y-axis, Z-axis, tilt, roll, and yaw positioning of the sensor, the mounting plate being coupled to the sight port door via one or more of translation fasteners and orientation fasteners;

mounting the mounting plate to the sight port door;

monitoring the interior of the heater using the sensor mounted to the sensor mount; and adjusting the one or more of X-axis, Y-axis, Z-axis, tilt, roll, and yaw positioning of the sensor via the one or more of the translation fasteners and the orientation fasteners.

25. The method of claim 24, further comprising inserting a filler into an existing sight port aperture.

26. The method of claim 24, further comprising installing the sensor onto a sensor mount of the multi-function sight port door.

27. The method of claim 24, the method being performed while a heater to which the sight port is installed is running.

28. The method of claim 24, the installing of the multi-function sight port door comprising mounting the sight port door to a sight port base via a hinge.

29. The method of claim 28, the hinge being offset to allow for opening of the sight port door at least 100 degrees.

30. The method of claim 24, wherein the mounting plate is coupled to the sight port door via one or more of the translation fasteners, the translation fasteners providing translation of the mounting plate along at least one of an X-axis, Y-axis, and Z-axis with respect to the sight port door.

31. The method of claim 24, wherein the mounting plate is coupled to the sight port door via one or more of the orientation fasteners, the orientation fasteners providing configuration of tilt, roll, and yaw of the mounting plate with respect to the sight port door.

32. The method of claim 24, further comprising securing the sight port door in a closed position using a steel hold-down clamp.

* * * * *